US008368495B2

(12) United States Patent
Fullerton et al.

(10) Patent No.: US 8,368,495 B2
(45) Date of Patent: Feb. 5, 2013

(54) SYSTEM AND METHOD FOR DEFINING MAGNETIC STRUCTURES

(75) Inventors: Larry W. Fullerton, New Hope, AL (US); Mark Roberts, Huntsville, AL (US); James Lee Richards, Fayetteville, TN (US); Ryan R. Fechner, Madison, AL (US); Kelly G. Loum, Athens, AL (US)

(73) Assignee: Correlated Magnetics Research LLC, New Hope, AL (US)

( * ) Notice: Subject to any disclaimer, the term of this patent is extended or adjusted under 35 U.S.C. 154(b) by 0 days.

(21) Appl. No.: 13/481,554

(22) Filed: May 25, 2012

(65) Prior Publication Data

US 2012/0306604 A1 Dec. 6, 2012

Related U.S. Application Data

(63) Continuation-in-part of application No. 13/351,203, filed on Jan. 16, 2012, and a continuation of application No. 13/157,975, filed on Jun. 10, 2011, now Pat. No. 8,098,122, which is a continuation of application No. 12/952,391, filed on Nov. 23, 2010, (Continued)

(51) Int. Cl.
*H01F 7/02* (2006.01)

(52) U.S. Cl. ..... 335/285; 335/306

(58) Field of Classification Search ..... 335/285, 335/306; 24/303

See application file for complete search history.

(56) References Cited

U.S. PATENT DOCUMENTS

| | | | |
|---|---|---|---|
| 381,968 | A | 5/1888 | Tesla |
| 493,858 | A | 3/1893 | Edison |
| 996,933 | A | 7/1911 | Lindquist |
| 1,236,234 | A | 8/1917 | Troje |
| 2,389,298 | A | 11/1945 | Ellis |
| 2,438,231 | A | 3/1948 | Shultz |
| 2,471,634 | A | 5/1949 | Vennice |
| 2,570,625 | A | 10/1951 | Zimmerman et al. |

(Continued)

FOREIGN PATENT DOCUMENTS

| | | | |
|---|---|---|---|
| DE | 2938782 | A1 | 4/1981 |
| EP | 0 345 554 | A1 | 12/1989 |

(Continued)

OTHER PUBLICATIONS

Series BNS, Compatible Series AES Safety Controllers, http://www.schmersalusa.com/safety_controllers/drawings/aes.pdf, pp. 159-175, date unknown.

(Continued)

*Primary Examiner* — Ramon Barrera
(74) *Attorney, Agent, or Firm* — James Richards

(57) ABSTRACT

An improved field emission system and method. The invention pertains to field emission structures comprising electric or magnetic field sources having magnitudes, polarities, and positions corresponding to a desired spatial force function where a spatial force is created based upon the relative alignment of the field emission structures and the spatial force function. The spatial force function may be based on one or more codes. In various embodiments, the code may be modified or varied. The code may be combined with another code. One or more aspects of the code, including spacing and amplitude, may be modulated or dithered according to a predefined pattern. Multiple magnet arrays may be combined, each based on a different code or portion of a code, resulting in a combination spatial force function. Magnet structures having differing field patterns may be used to generate a desired spatial force function related to a cross correlation of the two field patterns.

21 Claims, 34 Drawing Sheets

Related U.S. Application Data now Pat. No. 7,961,069, which is a continuation of application No. 12/478,911, filed on Jun. 5, 2009, now Pat. No. 7,843,295, which is a continuation-in-part of application No. 12/476,952, filed on Jun. 2, 2009, now Pat. No. 8,179,219, which is a continuation-in-part of application No. 12/322,561, filed on Feb. 4, 2009, now Pat. No. 8,115,581, which is a continuation-in-part of application No. 12/358,423, filed on Jan. 23, 2009, now Pat. No. 7,868,721, which is a continuation-in-part of application No. 12/123,718, filed on May 20, 2008, now Pat. No. 7,800,471, said application No. 12/952,391 is a continuation of application No. 12/478,950, filed on Jun. 5, 2009, now Pat. No. 7,843,296, said application No. 12/952,391 is a continuation of application No. 12/478,969, filed on Jun. 5, 2009, now Pat. No. 7,843,297, said application No. 12/952,391 is a continuation of application No. 12/479,013, filed on Jun. 5, 2009, now Pat. No. 7,839,247.

(60) Provisional application No. 61/519,664, filed on May 25, 2011, provisional application No. 61/123,019, filed on Apr. 4, 2008.

(56) References Cited

U.S. PATENT DOCUMENTS

| | | | |
|---|---|---|---|
| 2,722,617 | A | 11/1955 | Cluwen et al. |
| 3,102,314 | A | 9/1963 | Alderfer |
| 3,208,296 | A | 9/1965 | Baermann |
| 3,238,399 | A | 3/1966 | Johanees et al. |
| 3,288,511 | A | 11/1966 | Tavano |
| 3,408,104 | A | 10/1968 | Raynes |
| 2,932,545 | A | 4/1969 | Foley |
| 3,468,576 | A | 9/1969 | Beyer et al. |
| 3,474,366 | A | 10/1969 | Barney |
| 3,684,992 | A | 8/1972 | Huguet et al. |
| 3,696,258 | A | 10/1972 | Anderson et al. |
| 3,790,197 | A | 2/1974 | Parker |
| 3,791,309 | A | 2/1974 | Baermann |
| 3,802,034 | A | 4/1974 | Bookless |
| 3,845,430 | A | 10/1974 | Petkewicz et al. |
| 3,893,059 | A | 7/1975 | Nowak |
| 4,079,558 | A | 3/1978 | Forham |
| 4,129,846 | A | 12/1978 | Yablochnikov |
| 4,222,489 | A | 9/1980 | Hutter |
| 4,416,127 | A | 11/1983 | Gomez-Olea Naveda |
| 4,453,294 | A | 6/1984 | Morita |
| 4,535,278 | A | 8/1985 | Asakawa |
| 4,547,756 | A | 10/1985 | Miller et al. |
| 4,629,131 | A | 12/1986 | Podell |
| 4,849,749 | A | 7/1989 | Fukamachi et al. |
| 4,912,727 | A | 3/1990 | Schubert |
| 4,941,236 | A | 7/1990 | Sherman et al. |
| 5,020,625 | A | 6/1991 | Yamauchi et al. |
| 5,050,276 | A | 9/1991 | Pemberton |
| 5,345,207 | A | 9/1994 | Gebele |
| 5,367,891 | A | 11/1994 | Furuyama |
| 5,383,049 | A | 1/1995 | Carr |
| 5,440,997 | A | 8/1995 | Crowley |
| 5,461,386 | A | 10/1995 | Knebelkamp |
| 5,492,572 | A | 2/1996 | Schroeder et al. |
| 5,495,221 | A | 2/1996 | Post |
| 5,512,732 | A | 4/1996 | Yagnik et al. |
| 5,570,084 | A | 10/1996 | Ritter et al. |
| 5,604,960 | A | 2/1997 | Good |
| 5,631,093 | A | 5/1997 | Perry et al. |
| 5,631,618 | A | 5/1997 | Trumper et al. |
| 5,637,972 | A | 6/1997 | Randall et al. |
| 5,852,393 | A | 12/1998 | Reznik et al. |
| 5,956,778 | A | 9/1999 | Godoy |
| 5,983,406 | A | 11/1999 | Meyerrose |
| 6,072,251 | A | 6/2000 | Markle |
| 6,115,849 | A | 9/2000 | Meyerrose |
| 6,118,271 | A | 9/2000 | Ely et al. |
| 6,170,131 | B1 | 1/2001 | Shin |
| 6,205,012 | B1 | 3/2001 | Lear |
| 6,275,778 | B1 | 8/2001 | Shimada et al. |
| 6,285,097 | B1 | 9/2001 | Hazelton et al. |
| 6,387,096 | B1 | 5/2002 | Hyde, Jr. |
| 6,457,179 | B1 | 10/2002 | Prendergast |
| 6,467,326 | B1 | 10/2002 | Garrigus |
| 6,607,304 | B1 | 8/2003 | Lake et al. |
| 6,653,919 | B2 | 11/2003 | Shih-Chung et al. |
| 6,720,698 | B2 | 4/2004 | Galbraith |
| 6,842,332 | B1 | 1/2005 | Rubenson et al. |
| 6,847,134 | B2 | 1/2005 | Frissen et al. |
| 6,850,139 | B1 | 2/2005 | Dettmann et al. |
| 6,862,748 | B2 | 3/2005 | Prendergast |
| 6,927,657 | B1 | 8/2005 | Wu |
| 6,971,147 | B2 | 12/2005 | Halstead |
| 7,016,492 | B2 | 3/2006 | Pan et al. |
| 7,031,160 | B2 | 4/2006 | Tillotson |
| 7,065,860 | B2 | 6/2006 | Aoki et al. |
| 7,066,778 | B2 | 6/2006 | Kretzschmar |
| 7,362,018 | B1 | 4/2008 | Kulogo et al. |
| 7,444,683 | B2 | 11/2008 | Prendergast et al. |
| 7,583,500 | B2 | 9/2009 | Ligtenberg et al. |
| 7,775,567 | B2 | 8/2010 | Ligtenberg et al. |
| 7,808,349 | B2 | 10/2010 | Fullerton et al. |
| 7,812,697 | B2 | 10/2010 | Fullerton et al. |
| 7,839,246 | B2 | 11/2010 | Fullerton et al. |
| 7,868,721 | B2 | 1/2011 | Fullerton et al. |
| 2004/0003487 | A1 | 1/2004 | Reiter |
| 2004/0155748 | A1 | 8/2004 | Steingroever |
| 2004/0244636 | A1 | 12/2004 | Meadow et al. |
| 2004/0251759 | A1 | 12/2004 | Hirzel |
| 2005/0102802 | A1 | 5/2005 | Sitbon et al. |
| 2005/0231046 | A1 | 10/2005 | Aoshima |
| 2006/0066428 | A1 | 3/2006 | McCarthy et al. |
| 2006/0189259 | A1 | 8/2006 | Park et al. |
| 2006/0214756 | A1 | 9/2006 | Elliott et al. |
| 2006/0290451 | A1 | 12/2006 | Prendergast et al. |
| 2007/0075594 | A1 | 4/2007 | Sadler |
| 2007/0138806 | A1 | 6/2007 | Ligtenberg et al. |
| 2008/0139261 | A1 | 6/2008 | Cho et al. |
| 2008/0181804 | A1 | 7/2008 | Tanigawa et al. |
| 2008/0186683 | A1 | 8/2008 | Ligtenberg et al. |
| 2008/0272868 | A1 | 11/2008 | Prendergast et al. |
| 2008/0282517 | A1 | 11/2008 | Claro |
| 2009/0021333 | A1 | 1/2009 | Fiedler |
| 2010/0033280 | A1 | 2/2010 | Bird et al. |
| 2011/0210636 | A1 | 9/2011 | Kuhlmann-Wilsdorf |

FOREIGN PATENT DOCUMENTS

| | | | |
|---|---|---|---|
| EP | 0 545 737 | A1 | 6/1993 |
| FR | 823395 | | 1/1938 |
| GB | 1 495 677 | A | 12/1977 |
| JP | 60-091011 | U | 5/1985 |
| WO | WO-02/031945 | A2 | 4/2002 |
| WO | WO-2007/081830 | A2 | 7/2007 |
| WO | WO-2009/124030 | A1 | 10/2009 |

OTHER PUBLICATIONS

BNS 33 Range, Magnetic safety sensors, Rectangular design, http://www.farnell.com/datasheets/36449.pdf, 3 pages, date unknown.

Series BNS-B20, Coded-Magnet Sensor Safety Door Handle, http://www.schmersalusa.com/catalog_pdfs/BNS_B20.pdf, 2 pages, date unknown.

Series BNS333, Coded-Magnet Sensors with Integral Safety Control Module, http://www.schmersalusa.com/machine_guarding/coded_magnet/drawings/bns333.pdf, 2 pages, date unknown.

Wikipedia, "Barker Code", Web article, last modified Aug. 2, 2008, 2 pages.

Wikipedia, "Kasami Code", Web article, last modified Jun. 11, 2008, 1 page.

Wikipedia, "Linear feedback shift register", Web article, last modified Nov. 11, 2008, 6 pages.

Wikipedia, "Golomb Ruler", Web article, last modified Nov. 4, 2008, 3 pages.

Wikipedia, "Costas Array", Web article, last modified Oct. 7, 2008, 4 pages.
Wikipedia, "Walsh Code", Web article, last modified Sep. 17, 2008, 2 pages.
Wikipedia, "Gold Code", Web article, last modified Jul. 27, 2008, 1 page.
Wikipedia, "Bitter Electromagnet", Web article, last modified Aug. 2011,1 page.
Pill-soo Kim, "A future cost trends of magnetizer systems in Korea", Industrial Electronics, Control, and Instrumentation, 1996, vol. 2, Aug. 5, 1996, pp. 991-996.
United States Office Action, dated Aug. 26, 2011, issued in counterpart U.S. Appl. No. 12/206,270.
United States Office Action, dated Mar. 12, 2012, issued in counterpart U.S. Appl. No. 12/206,270.
United States Office Action, dated Feb. 2, 2011, issued in counterpart U.S. Appl. No. 12/476,952.
United States Office Action, dated Oct. 12, 2011, issued in counterpart U.S. Appl. No. 12/476,952.
United States Office Action, dated Mar. 9, 2012, issued in counterpart U.S. Appl. No. 13/371,280.
International Search Report and Written Opinion, dated May 14, 2009, issued in related International Application No. PCT/US2009/038925.
International Search Report and Written Opinion, dated Jul. 13, 2010, issued in related International Application No. PCT/US2010/021612.
International Search Report and Written Opinion dated Jun. 1, 2009, issued in related International Application No. PCT/US2009/002027.
International Search Report and Written Opinion, dated Aug. 18, 2010, issued in related International Application No. PCT/US2010/036443.
International Search Report and Written Opinion, dated Apr. 8, 2011 issued in related International Application No. PCT/US2010/049410.

310-1
304
306
1R = -1

310-2
304
306
1A +1R = 0

310-3
304
306
1A + 2R = -1

310-4
304
306
2A + 2R = 0

310-5
304
306
2A + 3R = -1

310-6
304
306
3A + 3R = 0

310-7
304
306
7A = 7

310-7
304
306
7A = 7

310-8
304
306
3A + 3R = 0

310-9
304
306
2A + 3R = -1

310-10
304
306
2A + 2R = 0

310-11
304
306
1A + 2R = -1

310-12
304
306
1A +1R = 0

310-13
304
306
1R = -1

FIG. 14A1
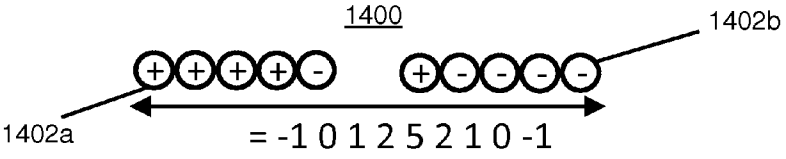
FIG. 14A2
| P | V | Pattern | P | V | Pattern |
|---|---|---|---|---|---|
| 5 | 5 | 1402a 1402b | | | |
| 4 | 2 | | 6 | 2 | |
| 3 | 1 | | 7 | 1 | |
| 2 | 0 | | 8 | 0 | |
| 1 | -1 | | 9 | -1 | |

FIG. 14B1
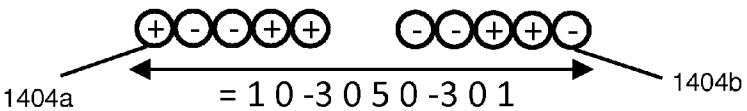
FIG. 14B2
| P | V | Pattern | P | V | Pattern |
|---|---|---|---|---|---|
| 5 | 5 | 1404a 1404b | | | |
| 4 | 0 | | 6 | 0 | |
| 3 | -3 | | 7 | -3 | |
| 2 | 0 | | 8 | 0 | |
| 1 | 1 | | 9 | 1 | |

= (-1 0 1 2 5 2 1 0 -1) + (1 0 -3 0 5 0 -3 0 1) = 0 0 -2 2 10 2 -2 0 0

FIG. 14E1 1411
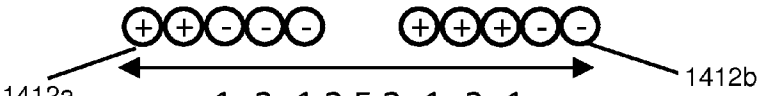
= -1 -2 -1 2 5 2 -1 -2 -1
FIG. 14E2
| P | V | Pattern | P | V | Pattern |
|---|---|---|---|---|---|
| 5 | 5 | 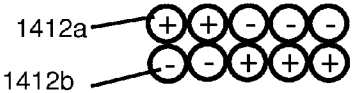 | | | |
| 4 | 2 |  | 6 | 2 |  |
| 3 | -1 |  | 7 | -1 |  |
| 2 | -2 |  | 8 | -2 |  |
| 1 | -1 |  | 9 | -1 |  |

FIG. 14F1
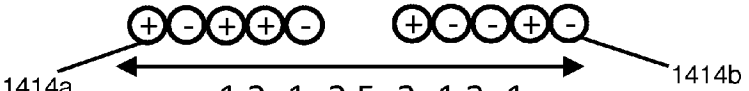
FIG. 14F2
| P | V | Pattern | P | V | Pattern |
|---|---|---|---|---|---|
| 5 | 5 | 1414a 1414b | | | |
| 4 | -2 | | 6 | -2 | |
| 3 | -1 | | 7 | -1 | |
| 2 | 2 | | 8 | 2 | |
| 1 | -1 | | 9 | -1 | |

= (-1 -2 -1 2 5 2 -1 -2 -1) + (-1 2 -1 -2 5 -2 -1 2 -1) = -2 0 -2 0 10 0 -2 0 -2

FIG. 14I1
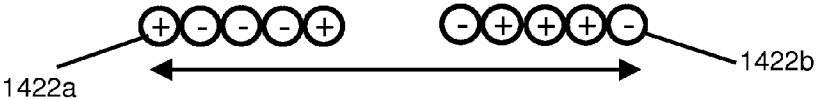
= 1 -2 -1 0 5 0 -1 -2 1
FIG. 14I2
| P | V | Pattern | P | V | Pattern |
|---|---|---|---|---|---|
| 5 | 5 | 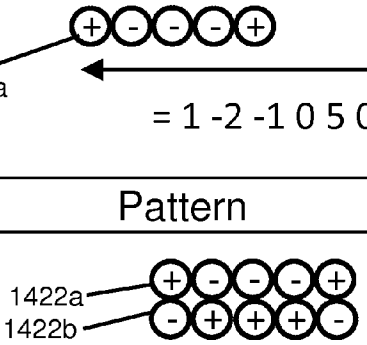 | | | |
| 4 | 0 |  | 6 | 0 |  |
| 3 | -1 |  | 7 | -1 |  |
| 2 | -2 |  | 8 | -2 |  |
| 1 | 1 |  | 9 | 1 |  |

= (-1 2 -1 -2 5 -2 -1 2 -1) + (1 -2 -1 0 5 0 -1 -2 1) = 0 0 -2 -2 10 -2 -2 0 0

FIG. 14L1
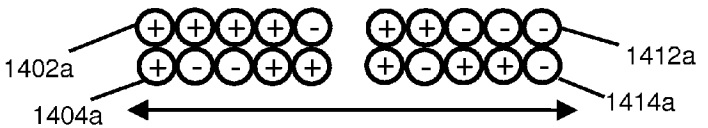
= (1 2 3 2 -1 -2 -3 0 1) + (1 -2 -1 4 -1 -2 1 0 -1) = 2 0 2 6 -2 -4 -2 0 0
FIG. 14L2
| P | V | Pattern | | P | V | Pattern |
|---|---|---|---|---|---|---|
| 5 | -1 | 1402a 1412a | | | | |
| 4 | 2 | | | 6 | -2 | |
| 3 | 3 | | | 7 | -3 | |
| 2 | 2 | | | 8 | 0 | |
| 1 | 1 | | | 9 | 1 | |

FIG. 14L3

| P | V | Pattern | | P | V | Pattern |
|---|---|---|---|---|---|---|
| 5 | -1 | 1404a 1414a | | | | |
| 4 | 4 | | | 6 | -2 | |
| 3 | -1 | | | 7 | 1 | |
| 2 | -2 | | | 8 | 0 | |
| 1 | 1 | | | 9 | -1 | |

1920

1940

SYSTEM AND METHOD FOR DEFINING MAGNETIC STRUCTURES

RELATED APPLICATIONS

This application is a continuation-in-part of Non-provisional application Ser. No. 13/351,203, titled "A Key System For Enabling Operation Of A Device", filed Jan. 16, 2012, by Fullerton et al, this application claims the benefit under 35 USC 119(e) of provisional application 61/519,664, titled "System and Method for Defining Magnetic Structures", filed May 25, 2011 by Roberts et al.; Ser. No. 13/351,203 is a continuation of application Ser. No. 13,157,975, titled "Magnetic Attachment System With Low Cross Correlation", filed Jun. 10, 2011, by Fullerton et al., U.S. Pat. No. 8,098,122, which is a continuation of application Ser. No. 12/952,391, titled: "Magnetic Attachment System", filed Nov. 23, 2010 by Fullerton et al., U.S. Pat. No. 7,961,069; which is a continuation of application Ser. No. 12/478,911, titled "Magnetically Attachable and Detachable Panel System" filed Jun. 5, 2009 by Fullerton et al., U.S. Pat. No. 7,843,295; Ser. No. 12/952,391 is also a continuation of application Ser. No. 12/478,950, titled "Magnetically Attachable and Detachable Panel Method," filed Jun. 5, 2009 by Fullerton et al., U.S. Pat. No. 7,843,296; Ser. No. 12/952,391 is also a continuation of application Ser. No. 12/478,969, titled "Coded Magnet Structures for Selective Association of Articles," filed Jun. 5, 2009 by Fullerton et al., U.S. Pat. No. 7,843,297; Ser. No. 12/952,391 is also a continuation of application Ser. No. 12/479,013, titled "Magnetic Force Profile System Using Coded Magnet Structures," filed Jun. 5, 2009 by Fullerton et al., U.S. Pat. No. 7,839,247; the preceding four applications above are each a continuation-in-part of Non-provisional application Ser. No. 12/476,952 filed Jun. 2, 2009, by Fullerton et al., titled "A Field Emission System and Method", which is a continuation-in-part of Non-provisional application Ser. No. 12/322,561, filed Feb. 4, 2009 by Fullerton et al., titled "System and Method for Producing an Electric Pulse", U.S. Pat. No. 8,115,581, which is a continuation-in-part application of Non-provisional application Ser. No. 12/358,423, filed Jan. 23, 2009 by Fullerton et al., titled "A Field Emission System and Method", U.S. Pat. No. 7,868,721 which is a continuation-in-part application of Non-provisional application Ser. No. 12/123,718, filed May 20, 2008 by Fullerton et al., titled "A Field Emission System and Method", U.S. Pat. No. 7,800,471, which claims the benefit under 35 USC 119(e) of U.S. Provisional Application Ser. No. 61/123,019, filed Apr. 4, 2008 by Fullerton, titled "A Field Emission System and Method". The applications and patents listed above are incorporated herein by reference in their entirety.

FIELD OF THE INVENTION

The present invention relates generally to a system and method for defining magnetic structures. More particularly, the present invention relates to a system and method for defining magnetic structures using combinations of codes.

BACKGROUND OF THE INVENTION

Alignment characteristics of magnetic fields have been used to achieve precision movement and positioning of objects. A key principle of operation of an alternating-current (AC) motor is that a permanent magnet will rotate so as to maintain its alignment within an external rotating magnetic field. This effect is the basis for the early AC motors including the "Electro Magnetic Motor" for which Nikola Tesla received U.S. Pat. No. 381,968 on May 1, 1888. On Jan. 19, 1938, Marius Lavet received French Patent 823,395 for the stepper motor which he first used in quartz watches. Stepper motors divide a motor's full rotation into a discrete number of steps. By controlling the times during which electromagnets around the motor are activated and deactivated, a motor's position can be controlled precisely. Computer-controlled stepper motors are one of the most versatile forms of positioning systems. They are typically digitally controlled as part of an open loop system, and are simpler and more rugged than closed loop servo systems. They are used in industrial high speed pick and place equipment and multi-axis computer numerical control (CNC) machines. In the field of lasers and optics they are frequently used in precision positioning equipment such as linear actuators, linear stages, rotation stages, goniometers, and mirror mounts. They are used in packaging machinery, and positioning of valve pilot stages for fluid control systems. They are also used in many commercial products including floppy disk drives, flatbed scanners, printers, plotters and the like.

Moreover, commercial, consumer, and industrial products and fabrication processes abound with a myriad of fasteners, latches, hinges, pivots, bearings and other devices that are conventionally based on mechanical strength and shape properties of materials rather than magnetic field properties because the magnetic field properties have been inadequate or otherwise unsuitable for the application.

Therefore there is a need for new magnetic field configurations providing new magnetic field properties that can improve and extend the operation of existing magnetic field devices and potentially bring the benefits of magnetic field operation to new devices and applications heretofore served only by purely mechanical devices.

BRIEF DESCRIPTION OF THE INVENTION

Briefly, the present invention relates to an improved field emission system and method. The invention pertains to field emission structures comprising electric or magnetic field sources having magnitudes, polarities, and positions corresponding to a desired spatial force function where a spatial force is created based upon the relative alignment of the field emission structures and the spatial force function. The spatial force function may be based on one or more codes. In various embodiments, the code may be modified or varied. The code may be combined with another code. One or more aspects of the code, including spacing and amplitude, may be modulated or dithered according to a predefined pattern. Multiple magnet arrays may be combined, each based on a different code or portion of a code, resulting in a combination spatial force function. Magnet structures having differing field patterns may be used to generate a desired spatial force function related to a cross correlation of the two field patterns.

In accordance with one aspect of the present invention field strengths may be varied from magnetic source to magnetic source in accordance with a code. Such a code may be periodic or aperiodic and may be contiguous or non-contiguous.

In accordance with one aspect of the present invention, the locations of magnetic sources in a magnetic structure may be dithered in accordance with a dithering code, for example a pseudorandom dithering code.

In accordance with one aspect of the present invention, the period of a code can be varied across multiple portions to achieve a combinatory correlation function, where a code may have a first period in a first portion of a structure and the same code might have a second period in a second portion of the structure. For example, three modulos of a code might be used to define the polarities of magnetic sources in a first portion of a structure and two modulos of the same code might be used to define the polarities of magnetic sources in a second portion of the structure, where the movement range may be the same for both portions, e.g., in a parallel implementation. Alternatively, the portions may be non-parallel.

In accordance with one aspect of the present invention, a code element may map to a group of printed magnetic sources which may or may not overlap. As such, a magnetic source or group of magnetic sources may comprise any shape or region within a portion of a magnetic structure.

In accordance with one aspect of the invention, a field emission system comprises a first field emission structure and a second field emission structure. The first and second field emission structures each comprise an array of field emission sources each having positions and polarities relating to a desired spatial force function that corresponds to the relative alignment of the first and second field emission structures within a field domain. The positions and polarities of each field emission source of each array of field emission sources can be determined in accordance with at least one correlation function. The at least one correlation function can be in accordance with at least one code. The at least one code can be at least one of a pseudorandom code, a deterministic code, or a designed code. The at least one code can be a one dimensional code, a two dimensional code, a three dimensional code, or a four dimensional code.

Each field emission source of each array of field emission sources has a corresponding field emission amplitude and vector direction determined in accordance with the desired spatial force function, where a separation distance between the first and second field emission structures and the relative alignment of the first and second field emission structures creates a spatial force in accordance with the desired spatial force function. The spatial force comprises at least one of an attractive spatial force or a repellant spatial force. The spatial force corresponds to a peak spatial force of said desired spatial force function when said first and second field emission structures are substantially aligned such that each field emission source of said first field emission structure substantially aligns with a corresponding field emission source of said second field emission structure. The spatial force can be used to produce energy, transfer energy, move an object, affix an object, automate a function, control a tool, make a sound, heat an environment, cool an environment, affect pressure of an environment, control flow of a fluid, control flow of a gas, and control centrifugal forces.

Under one arrangement, the spatial force is typically about an order of magnitude less than the peak spatial force when the first and second field emission structures are not substantially aligned such that field emission source of the first field emission structure substantially aligns with a corresponding field emission source of said second field emission structure.

A field domain corresponds to field emissions from the array of first field emission sources of the first field emission structure interacting with field emissions from the array of second field emission sources of the second field emission structure.

The relative alignment of the first and second field emission structures can result from a respective movement path function of at least one of the first and second field emission structures where the respective movement path function is one of a one-dimensional movement path function, a two-dimensional movement path function or a three-dimensional movement path function. A respective movement path function can be at least one of a linear movement path function, a non-linear movement path function, a rotational movement path function, a cylindrical movement path function, or a spherical movement path function. A respective movement path function defines movement versus time for at least one of the first and second field emission structures, where the movement can be at least one of forward movement, backward movement, upward movement, downward movement, left movement, right movement, yaw, pitch, and or roll. Under one arrangement, a movement path function would define a movement vector having a direction and amplitude that varies over time.

Each array of field emission sources can be one of a one-dimensional array, a two-dimensional array, or a three-dimensional array. The polarities of the field emission sources can be at least one of North-South polarities or positive-negative polarities. At least one of the field emission sources comprises a magnetic field emission source or an electric field emission source. At least one of the field emission sources can be a permanent magnet, an electromagnet, an electret, a magnetized ferromagnetic material, a portion of a magnetized ferromagnetic material, a soft magnetic material, or a superconductive magnetic material. At least one of the first and second field emission structures can be at least one of a back keeper layer, a front saturable layer, an active intermediate element, a passive intermediate element, a lever, a latch, a swivel, a heat source, a heat sink, an inductive loop, a plating nichrome wire, an embedded wire, or a kill mechanism. At least one of the first and second field emission structures can be a planer structure, a conical structure, a cylindrical structure, a curve surface, or a stepped surface.

In accordance with another aspect of the invention, a method of controlling field emissions comprises defining a desired spatial force function corresponding to the relative alignment of a first field emission structure and a second field emission structure within a field domain and establishing, in accordance with the desired spatial force function, a position and polarity of each field emission source of a first array of field emission sources corresponding to the first field emission structure and of each field emission source of a second array of field emission sources corresponding to the second field emission structure.

In accordance with a further aspect of the invention, a field emission system comprises a first field emission structure comprising a plurality of first field emission sources having positions and polarities in accordance with a first correlation function and a second field emission structure comprising a plurality of second field emission source having positions and polarities in accordance with a second correlation function, the first and second correlation functions corresponding to a desired spatial force function, the first correlation function complementing the second correlation function such that each field emission source of said plurality of first field emission sources has a corresponding counterpart field emission source of the plurality of second field emission sources and the first and second field emission structures will substantially correlate when each of the field emission source counterparts are substantially aligned.

In a further aspect, field emission sources may be arranged based on a code having a autocorrelation function with a single maximum peak per code modulo. The first magnet structure and complementary magnet structure may have an operational range of relative position; wherein magnetic force between said first magnet structure and said complementary magnet structure as a function of position within the operational range corresponds to the autocorrelation function. Peak to maximum sidelobe autocorrelation levels available from exemplary codes may include (but not limited to) $|N/2|$, $|2|$, $|1|$, $+1$, or $-1$, where the operator "$|x|$" is absolute value. A sidelobe is a response that is at a position that is off of the main response, typically may be a local maximum response (a secondary peak).

In other aspects, field emission sources may be arranged in one or more rings about a center. In one embodiment, the code for the ring sources may be a cyclic code. One or more additional magnetic field sources may be added. The ring structure may include a mechanical constraint, for example, a spindle or alternatively a shell, to limit lateral motion and allow rotational motion.

In a further aspect, a mechanical limit may be provided in conjunction with magnetic mounting of a panel to assist in supporting the panel, while still allowing a release mechanism requiring less force for release than the holding force of the magnetic mounting.

In several aspect of the invention, the magnet structure may comprise magnetic components arranged according to a variable code, the variable code may comprise a polarity code and/or a spacing code. The variable code may comprise a random or pseudorandom code, for example, but not limited to a Barker code, an LFSR code, a Kasami code, a Gold code, Golomb ruler code, and a Costas array. The magnetic field components may be individual magnets or different magnetized portions in a single contiguous piece of magnet material.

Specific variations include two dimensional codes found by the inventors.

These and further benefits and features of the present invention are herein described in detail with reference to exemplary embodiments in accordance with the invention.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

FIGS. 1-9 are various diagrams used to help explain different concepts about correlated magnetic technology which can be utilized in an embodiment of the present invention;

FIG. 1 illustrates an exemplary magnet which has a South pole and a North pole;

FIG. 5 is a diagram depicting a correlating magnet surface being wrapped back on itself on a cylinder;

FIG. 6 is a diagram depicting an exemplary cylinder having wrapped thereon a first magnetic field emission structure with a code pattern that is repeated six times around the outside of the cylinder;

FIG. 8 illustrates an exemplary 3-D correlated electromagnetics example where there is a first cylinder which is slightly larger than a second cylinder that is contained inside the first cylinder;

FIG. 9 illustrates an exemplary valve mechanism 900 based upon a sphere;

FIG. 14A1 and FIG. 14A2 depict an exemplary magnetic system of two complementary magnetic structures comprising one-dimensional arrays of magnetic sources coded in accordance with a code having a peak force to maximum off peak force ratio of 2.5;

FIG. 14B1 and FIG. 14B2 depict an exemplary magnetic system of two complementary magnetic structures comprising one-dimensional arrays of magnetic sources coded in accordance with a code having a peak force to maximum off peak force ratio of 1.67;

FIG. 14E1 and FIG. 14E2 depict another exemplary magnetic system of two complementary magnetic structures comprising one-dimensional arrays of magnetic sources coded in accordance with a code having a peak force to maximum off peak force ratio of 2.5;

FIG. 14F1 and FIG. 14F2 depict yet another exemplary magnetic system of two complementary magnetic structures comprising one-dimensional arrays of magnetic sources coded in accordance with a code having a peak force to maximum off peak force ratio of 2.5;

FIG. 14I1 and FIG. 14I2 depict still another exemplary magnetic system of two complementary magnetic structures comprising one-dimensional arrays of magnetic sources coded in accordance with a code having a peak force to maximum off peak force ratio of 2.5;

FIG. 14L1, FIG. 14L2 and FIG. 14L3 depict the correlation of one of the magnetic structures of FIG. 14C with one of the magnetic structures of 14G where the peak force to maximum off peak force ratio is 1.5;

DETAILED DESCRIPTION OF THE INVENTION

Figure 1:
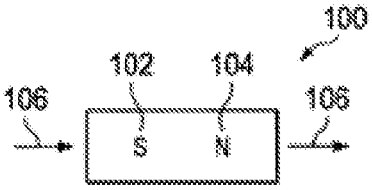

The present invention will now be described more fully in detail with reference to the accompanying drawings, in which the preferred embodiments of the invention are shown. This invention should not, however, be construed as limited to the embodiments set forth herein; rather, they are provided so that this disclosure will be thorough and complete and will fully convey the scope of the invention to those skilled in the art.

The present invention provides a system and method for defining magnetic structures using combinations of codes. It involves magnetic techniques related to those described in U.S. Pat. No. 7,800,471, issued Sep. 21, 2010, U.S. Pat. No. 7,868,721, issued Jan. 11, 2011, U.S. patent application Ser. No. 12/476,952, filed Jun. 2, 2009, and U.S. patent application Ser. No. 12/885,450, filed Sep. 18, 2010, which are all incorporated herein by reference in their entirety. The present invention may be applicable to systems and methods described in U.S. Pat. No. 7,681,256, issued Mar. 23, 2010, U.S. Pat. No. 7,750,781, issued Jul. 6, 2010, U.S. Pat. No. 7,755,462, issued Jul. 13, 2010, U.S. Pat. No. 7,812,698, issued Oct. 12, 2010, U.S. Pat. Nos. 7,817,002, 7,817,003, 7,817,004, 7,817,005, and 7,817,006, issued Oct. 19, 2010, U.S. Pat. No. 7,821,367, issued Oct. 26, 2010, U.S. Pat. Nos. 7,823,300 and 7,824,083, issued Nov. 2, 2010, U.S. Pat. No. 7,839,247, issued Nov. 23, 2010, and U.S. Pat. Nos. 7,843,295, 7,843,296, and 7,843,297, issued Nov. 30, 2010, U.S. Pat. No. 7,893,803, issued Feb. 22, 2011, U.S. Pat. No. 7,834,729, issued Nov. 16, 2010, U.S. patent application Ser. No. 12/322,561, filed Feb. 4, 2009, U.S. patent application Ser. No. 12/479,821, filed Jun. 7, 2009, U.S. patent application Ser. No. 12/496,463, filed Jul. 1, 2009, and U.S. patent application Ser. Nos. 12/894,837, 12/895,061, and 12/895,589, filed Sep. 30, 2010, and U.S. patent application Ser. Nos. 12/896,383, 12/896,424, 12/896,453, and 12/896,723, filed Oct. 1, 2010, which are all incorporated by reference herein in their entirety. The invention may also incorporate techniques described in U.S. Provisional Patent Application 61/403,814, filed Sep. 22, 2010, U.S. Provisional Patent Application 61/404,147, filed Sep. 27, 2010, U.S. Provisional Patent Application 61/455,820, filed Oct. 27, 2010, U.S. Provisional Patent Application 61/459,329, filed Dec. 10, 2010, U.S. Provisional Patent Application 61/459,994, filed Dec. 22, 2010, U.S. Provisional Patent Application 61/461,570, filed Jan. 21, 2011, and U.S. Provisional Patent Application 61,426,715, filed Feb. 7, 2011, which are all incorporated by reference herein in their entirety.

In accordance with one embodiment of the invention, a magnetic device comprises a first magnetic structure and a second magnetic structure. The first magnetic structure has a first plurality of portions each having a plurality of magnetic sources, where the polarities of the magnetic sources of each of the first plurality of portions are defined in accordance with a corresponding first plurality of codes. The second magnetic structure has a second plurality of portions each having a plurality of magnetic sources, where the polarities of the magnetic sources of each of the second plurality of portions are defined in accordance with a corresponding second plurality of codes. The possible combinations of the magnetic sources of the first plurality of portions of the first magnetic structure and the second plurality of portions of the second magnetic structure produce forces are in accordance with a spatial force function determined by the possible combinations of the first plurality of codes and the second plurality of codes. The movement of the first magnetic structure relative to the second magnetic structure can be constrained either rotationally or translationally. The magnetic sources employed in the invention may be permanent magnetic sources, electromagnets, electro-permanent magnets, or combinations thereof. Magnetic sources may be discrete magnets or may be magnetized into magnetizable material.

Correlated Magnetics Technology

This section is provided to introduce the reader to basic magnets and the new and revolutionary correlated magnetic technology. This section includes subsections relating to basic magnets, correlated magnets, and correlated electromagnetics. It should be understood that this section is provided to assist the reader with understanding the present invention, and should not be used to limit the scope of the present invention.

A. Magnets

A magnet is a material or object that produces a magnetic field which is a vector field that has a direction and a magnitude (also called strength). Referring to FIG. 1, illustrates an exemplary magnet 100 which has a South pole 102 and a North pole 104 and magnetic field vectors 106 that represent the direction and magnitude of the magnet's moment. The magnet's moment is a vector that characterizes the overall magnetic properties of the magnet 100. For a bar magnet, the direction of the magnetic moment points from the South pole 102 to the North pole 104. The North and South poles 104 and 102 are also referred to herein as positive (+) and negative (−) poles, respectively.

Figure 2A:
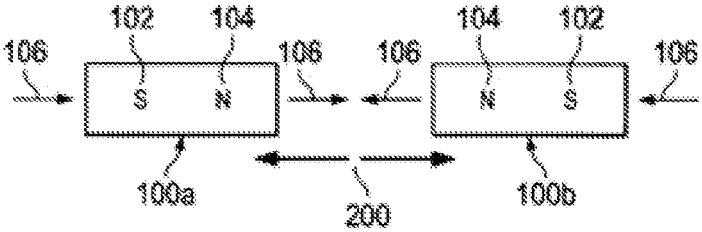
FIG. 2A and FIG. 2B illustrate two magnets in attracting and repelling configurations.
Figure 2B:
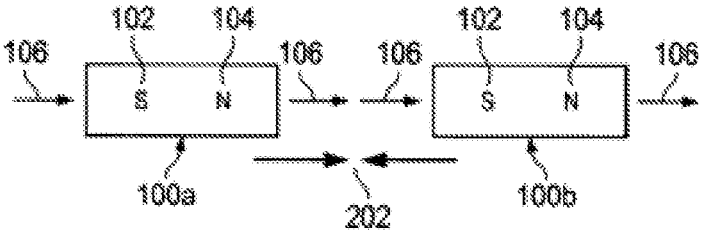
Figure 2C:
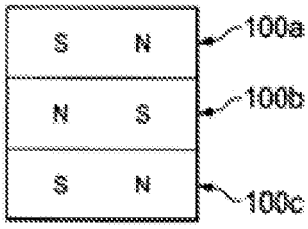
FIG. 2C illustrates the stacking of magnets with alternating polarities.

FIG. 2A is a diagram that depicts two magnets 100*a* and 100*b* aligned such that their polarities are opposite in direction resulting in a repelling spatial force 200 which causes the two magnets 100*a* and 100*b* to repel each other. In contrast, FIG. 2B is a diagram that depicts two magnets 100*a* and 100*b* aligned such that their polarities are in the same direction resulting in an attracting spatial force 202 which causes the two magnets 100*a* and 100*b* to attract each other. In FIG. 2B, the magnets 100*a* and 100*b* are shown as being aligned with one another but they can also be partially aligned with one another where they could still "stick" to each other and maintain their positions relative to each other. FIG. 2C is a diagram that illustrates how magnets 100*a*, 100*b* and 100*c* will naturally stack on one another such that their poles alternate.

B. Correlated Magnets

Correlated magnets can be created in a wide variety of ways depending on the particular application as described in the aforementioned U.S. Pat. Nos. 7,800,471 and 7,868,721 and U.S. patent application Ser. No. 12/476,952 by using a unique combination of magnet arrays (referred to herein as magnetic field emission sources or magnetic sources), correlation theory (commonly associated with probability theory and statistics) and coding theory (commonly associated with communication systems). A brief discussion is provided next to explain how these widely diverse technologies are used in a unique and novel way to create correlated magnets.

Basically, correlated magnets are made from a combination of magnetic (or electric) field emission sources which have been configured in accordance with a pre-selected code having desirable correlation properties. Thus, when a magnetic field emission structure (or magnetic structure) is brought into alignment with a complementary, or mirror image, magnetic field emission structure the various magnetic field emission sources will all align causing a peak spatial attraction force to be produced, while the misalignment of the magnetic field emission structures cause the various magnetic field emission sources to substantially cancel each other out in a manner that is a function of the particular code used to design the two magnetic field emission structures. In contrast, when a magnetic field emission structure is brought into alignment with a duplicate magnetic field emission structure then the various magnetic field emission sources all align causing a peak spatial repelling force to be produced, while the misalignment of the magnetic field emission structures causes the various magnetic field emission sources to substantially cancel each other out in a manner that is a function of the particular code used to design the two magnetic field emission structures.

The aforementioned spatial forces (attraction, repelling) have a magnitude that is a function of the relative alignment of two magnetic field emission structures and their corresponding spatial force (or correlation) function, the spacing (or distance) between the two magnetic field emission structures, and the magnetic field strengths and polarities of the various sources making up the two magnetic field emission structures. The spatial force functions can be used to achieve precision alignment and precision positioning not possible with basic magnets. Moreover, the spatial force functions can enable the precise control of magnetic fields and associated spatial forces thereby enabling new forms of attachment devices for attaching objects with precise alignment and new systems and methods for controlling precision movement of objects. An additional unique characteristic associated with correlated magnets relates to the situation where the various magnetic field sources making-up two magnetic field emission structures can effectively cancel out each other when they are brought out of alignment which is described herein as a release force. This release force is a direct result of the particular correlation coding used to configure the magnetic field emission structures.

There are many different types of codes that have different correlation properties which have been used in communications for channelization purposes, energy spreading, modulation, and other purposes. Many of the basic characteristics of such codes make them applicable for use in producing the magnetic field emission structures described herein. For example, Barker codes are known for their autocorrelation properties and can be used to configure correlated magnets.

Figure 2D:
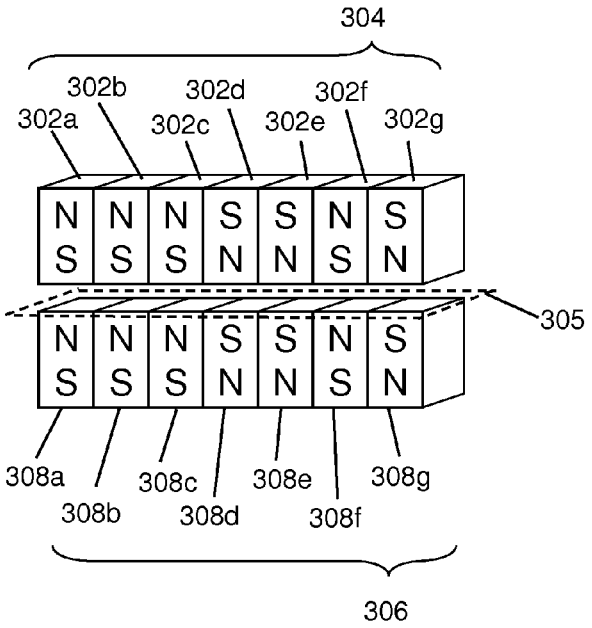
FIG. 2D illustrates two exemplary arrays of magnets arranged according to a code.

FIG. 2D illustrates two exemplary arrays of magnets arranged according to a code. FIG. 2D shows magnet array 304 comprising magnets 302*a*-302*g* and magnet array 306 comprising magnets 308*a*-308*g*. The magnet arrays are separated by an interface boundary 305. Array 304 and array 306 are arranged according to a seven element length Barker code, alternatively referred to as a Barker 7 code. In particular, the sequence of polarities of the magnets of FIG. 2D corresponds to the Barker 7 sequence, being: +1, +1, +1, −1, −1, +1, −1. Accordingly the magnets for array 306 are arranged with the north pole to the top corresponding to +1 and south pole at the top corresponding to −1, or NNNSSNS at the top face of the magnets.

The magnets of each array 304 and 305 are fixed in relation to one another within each array, but the arrays are movable in relation to one another. In particular the arrays may be moved laterally along the interface boundary 305 relative to one another.

The polarities of magnets in this disclosure are typically referred to in relation to the face of the magnet exposed to the interface boundary unless the context is clearly otherwise. Thus, the magnets of array 304 are opposite in polarity to the magnets of array 306.

Magnet structures 304 and 306 are referred to as complementary magnet structures. The magnet structures are complementary in that each magnet of 306 has a corresponding magnet of 304 and that the two magnet arrays may be positioned so that all corresponding magnet structures act on one another simultaneously across the interface boundary. The corresponding magnet polarities may be opposite, as shown, producing a strong attracting force, or may be the same (not shown) producing a strong repelling force, when the forces between all of the magnet pairs are summed.

The magnets of each structure 304 or 306 should be equal in strength in accordance with the Barker code, however, the magnet arrays need not have the same strength. For example each magnet of array 306 may be twice the strength of each magnet of 304 and the resulting forces will be scaled accordingly.

Although, a Barker code is used in various examples in this disclosure, other types of codes may also be applicable to correlated magnets because of their autocorrelation, cross-correlation, or other properties. These codes may include, but are not limited to: Gold codes, Kasami sequences, hyperbolic congruential codes, quadratic congruential codes, linear congruential codes, Welch-Costas array codes, Golomb-Costas array codes, pseudorandom codes, maximal length PN codes, chaotic codes, Optimal Golomb Ruler codes, deterministic codes, designed codes, one dimensional codes, two dimensional codes, three dimensional codes, or four dimensional codes, combinations thereof.

In a case where a code of a specific length is required and a high performance code such as a Barker code or maximal length PN code is not available for that length, one may often truncate or pad another known high performing code to achieve the desired length. The resulting altered code will often be degraded only slightly and may be usable. For example if a code of length 12 is desired, one may select a Barker 13 and remove a +1 from the end. Alternatively one may select a Barker 11 and add another +1 to the end to achieve a length of 12.

The Barker code example uses equal magnitude code elements at equal spacing, varying in polarity. Other codes may vary the spacing and/or magnitude and/or polarity. The Barker code example uses a discrete position to define the code. Other codes may use a continuous function to define the code and magnet structure.

Figures 3A, 3B, 3C, 3D, 3E, 3F, 3G, 3H, 3I, 3J, 3K, 3L, 3M, 3N:
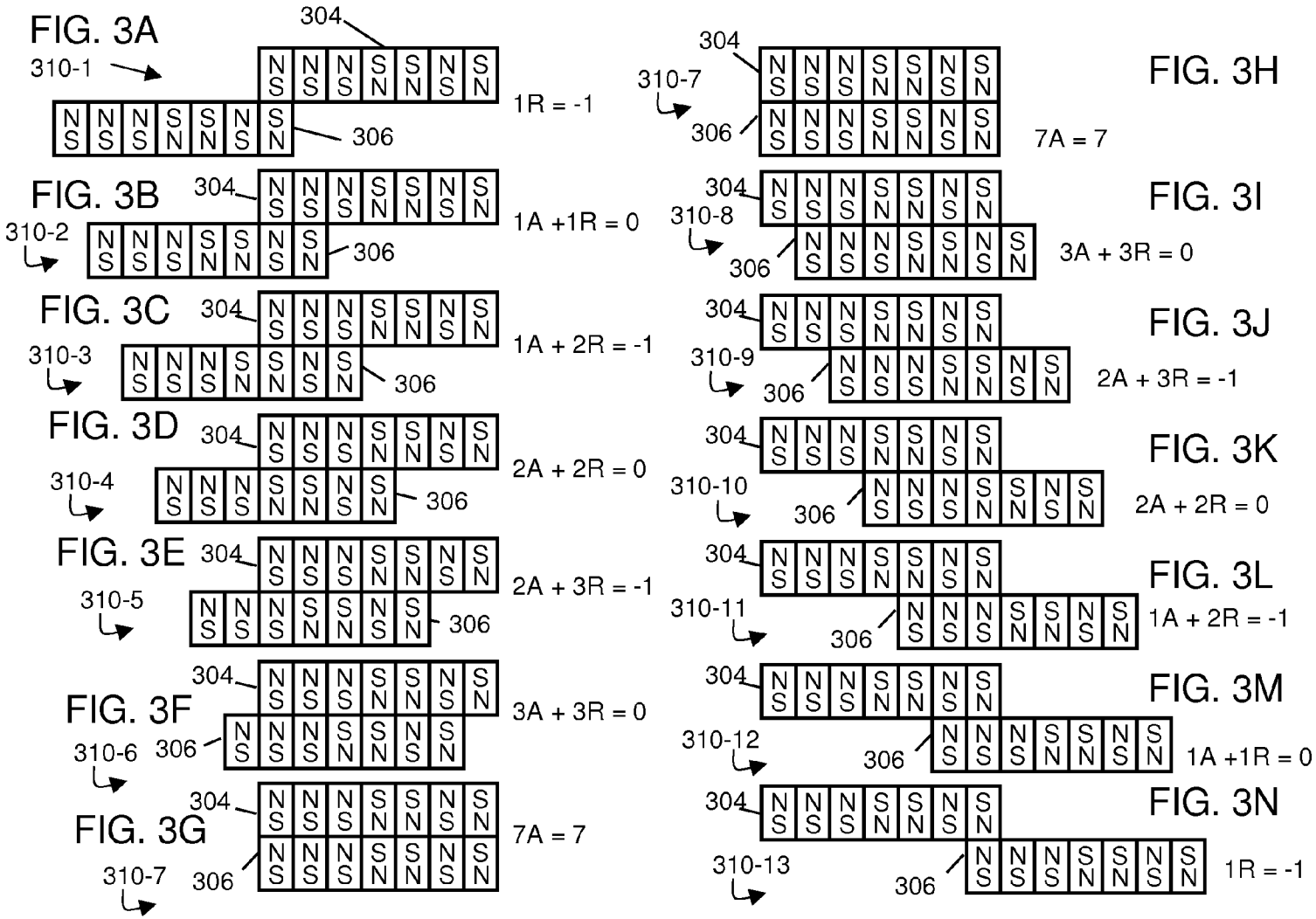
FIG. 3A-FIG. 3P illustrate the development of a spatial force function for two magnet structures configured in accordance with a Barker 7 code.

FIGS. 3A-3N represent Barker 7 magnet structures at several relative shifted positions showing the development of a spatial force function Each magnet 302*a*, 302*b* . . . 302*g* has the same or substantially the same magnetic field strength (or amplitude), which for the sake of this example is provided as a unit of 1 (where A=Attract, R=Repel, A=−R, A=1, R=−1). A second exemplary magnetic field emission structure 306 (including magnets 308*a*, 308*b* . . . 308*g*) that is identical to the first magnetic field emission structure 304 is shown in 13 different alignments 310-1 through 310-13 relative to the first magnetic field emission structure 304. For each relative alignment, the number of magnet pairs that repel plus the number of magnet pairs that attract is calculated, where each alignment has a spatial force in accordance with a spatial force function based upon the correlation function and magnetic field strengths of the magnets 302*a*, 302*b* . . . 302*g* and 308*a*, 308*b* . . . 308*g*. With the specific Barker code used, the spatial force varies from −1 to 7, where the maximum peak magnitude occurs when the two magnetic field emission structures 304 and 306 are aligned which occurs when their respective codes are aligned. This may be referred to as an alignment position or an alignment configuration. The off peak spatial force, referred to as a side lobe force, varies from 0 to −1. As such, the spatial force function causes the magnetic field emission structures 304 and 306 to generally repel each other unless they are aligned such that each of their magnets are correlated with a complementary magnet (i.e., a magnet's South pole aligns with another magnet's North pole, or vice versa). In other words, the two magnetic field emission structures 304 and 306 substantially correlate with one another when they are aligned to substantially mirror each other.

Figure 3O:
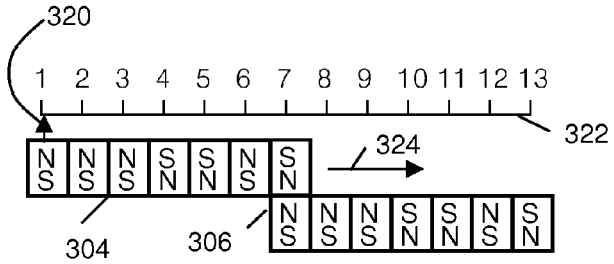

FIG. 3O depicts the shifting of the two magnet arrays as shown in FIGS. 3A-3N. FIG. 3O shows magnet array 306 stationary with magnet array 304 being shifted in direction 324. A reference marker 320 shows the position according to scale 322.

Figure 3P:
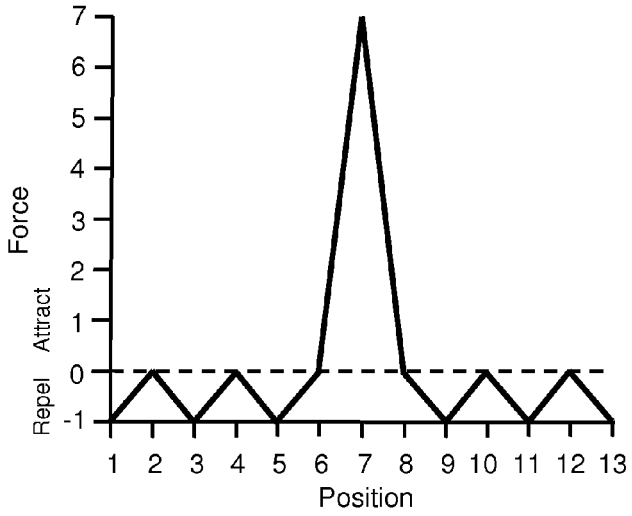

FIG. 3P is a graph of the spatial force function developed in accordance with FIGS. 3A-3O.

FIG. 3P is a plot that depicts the spatial force function of the two magnetic field emission structures 304 and 306 which results from the binary autocorrelation function of the Barker length 7 code, where the values at each alignment position 1 through 13 correspond to the spatial force values that were calculated for the thirteen alignment positions 310-1 through 310-13 between the two magnetic field emission structures 304 and 306 depicted in FIG. 3A. As the autocorrelation function for identical polarity correlated magnet field structures is repulsive, and many of the uses typically envisioned have attractive correlation peaks, the usage of the term 'autocorrelation' herein typically refers to attraction correlation. That is, the interacting faces of two such correlated magnetic field emission structures 304 and 306 will be complementary to (i.e., mirror images of) each other. This complementary autocorrelation relationship can be seen in FIG. 3A where the bottom face of the first magnetic field emission structure 304 having the pattern 'S S S N N S N' is shown interacting with the top face of the second magnetic field emission structure 306 having the pattern 'N N N S S N S', which is the mirror image (pattern) of the bottom face of the first magnetic field emission structure 304.

The attraction functions of FIG. 3P and others in this disclosure are idealized, but illustrate the main principle and primary performance. The curves show the performance assuming equal magnet size, shape, and strength and equal distance between corresponding magnets. For simplicity, the plots only show discrete integer positions and interpolate linearly. The linear interpolation is most accurate for thin magnets of full width, equal to the spacing. Actual force values may vary from the graph due to various factors such as diagonal coupling of adjacent or other distant magnets, magnet shape, spacing between magnets, magnet width and length, properties of magnetic materials, etc. The curves also assume equal attract and repel forces for equal distances. Such forces may vary and may not be exactly equal depending on magnet material and field strengths. High coercive force materials typically perform well in this regard.

Figure 4A:
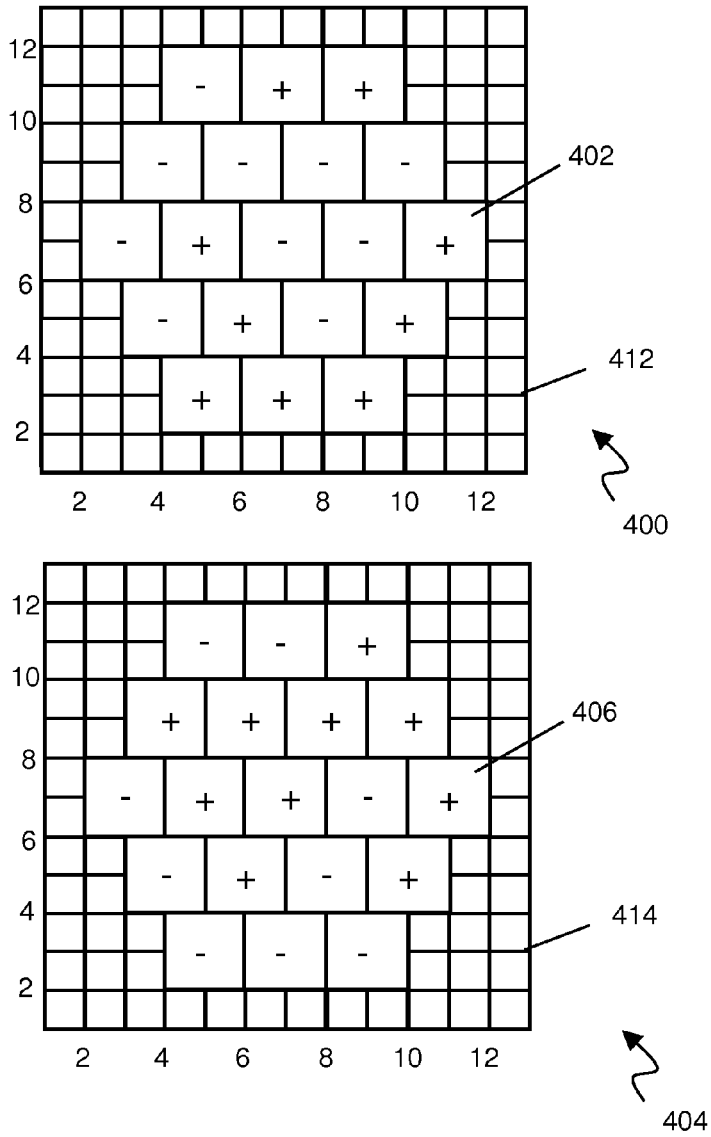
FIG. 4A-FIG. 4C illustrate an exemplary two dimensional magnetic field structure and associated spatial force functions.
Figure 4B:
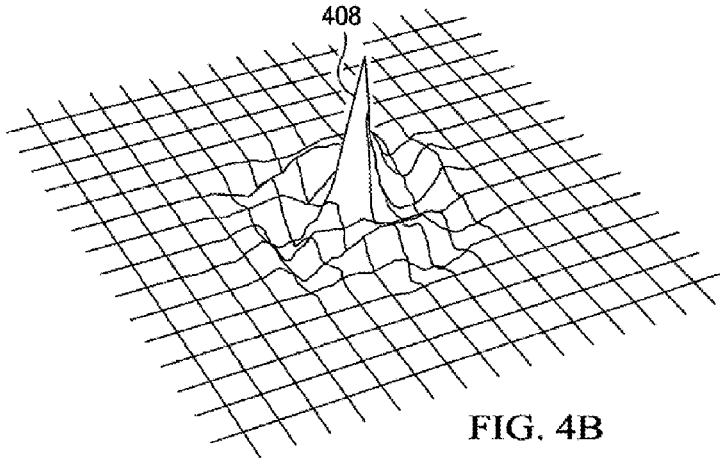
Figure 4C:
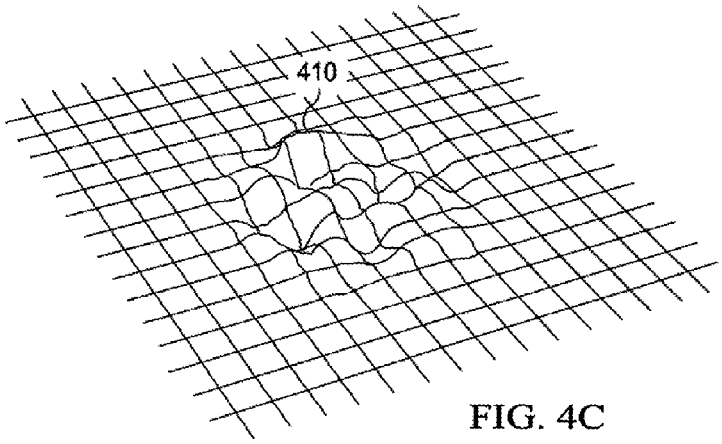

FIG. 4A is a diagram of an array of 19 magnets 400 positioned in accordance with an exemplary code to produce an exemplary magnetic field emission structure 402. The magnets are arranged according to a coordinate grid 412. Another array of 19 magnets 404 complementary to FIG. 4A is used to produce a mirror image magnetic field emission structure 406 on coordinate grid 414. In this example, the exemplary code produces the first magnetic field emission structure 402 to have a first stronger lock when aligned with its mirror image magnetic field emission structure 406 and a second weaker lock when it is rotated 90° relative to its mirror image magnetic field emission structure 406. FIG. 4B depicts a spatial force function 408 of the magnetic field emission structure 402 interacting with its mirror image magnetic field emission structure 406 to produce the first stronger lock. As can be seen, the spatial force function 408 has a peak which occurs when the two magnetic field emission structures 402 and 406 are substantially aligned. FIG. 4C depicts a spatial force function 410 of the magnetic field emission structure 402 interacting with its mirror magnetic field emission structure 406 after being rotated 90°. As can be seen, the spatial force function 410 has a smaller peak which occurs when the two magnetic field emission structures 402 and 406 are substantially aligned but one structure is rotated 90°. If the two magnetic field emission structures 402 and 406 are in other positions then they could be easily separated.

Figure 5:
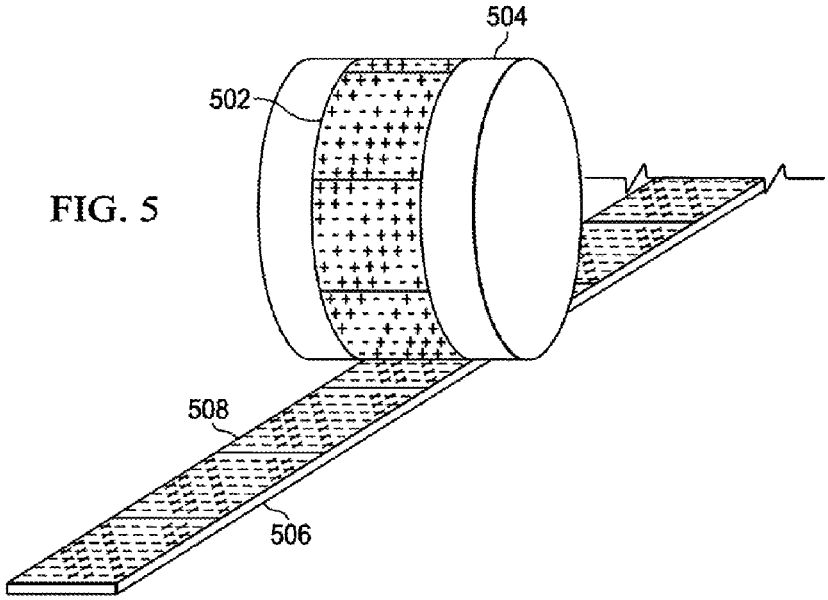

FIG. 5 is a diagram depicting a correlating magnet surface 502 being wrapped back on itself on a cylinder 504 (or disc 504, wheel 504) and a conveyor belt/tracked structure 506 having located thereon a mirror image correlating magnet surface 508. In this case, the cylinder 504 can be turned clockwise or counter-clockwise by some force so as to roll along the conveyor belt/tracked structure 506. The fixed magnetic field emission structures 502 and 508 provide a traction and gripping (i.e., holding) force as the cylinder 504 is turned by some other mechanism (e.g., a motor). The gripping force would remain substantially constant as the cylinder 504 moved down the conveyor belt/tracked structure 506 independent of friction or gravity and could therefore be used to move an object about a track that moved up a wall, across a ceiling, or in any other desired direction within the limits of the gravitational force (as a function of the weight of the object) overcoming the spatial force of the aligning magnetic field emission structures 502 and 508. If desired, this cylinder 504 (or other rotary devices) can also be operated against other rotary correlating surfaces to provide a gear-like operation. Since the hold-down force equals the traction force, these gears can be loosely connected and still give positive, non-slipping rotational accuracy. Plus, the magnetic field emission structures 502 and 508 can have surfaces which are perfectly smooth and still provide positive, non-slip traction. In contrast to legacy friction-based wheels, the traction force provided by the magnetic field emission structures 502 and 508 is largely independent of the friction forces between the traction wheel and the traction surface and can be employed with low friction surfaces. Devices moving about based on magnetic traction can be operated independently of gravity for example in weightless conditions including space, underwater, vertical surfaces and even upside down.

Figure 6:
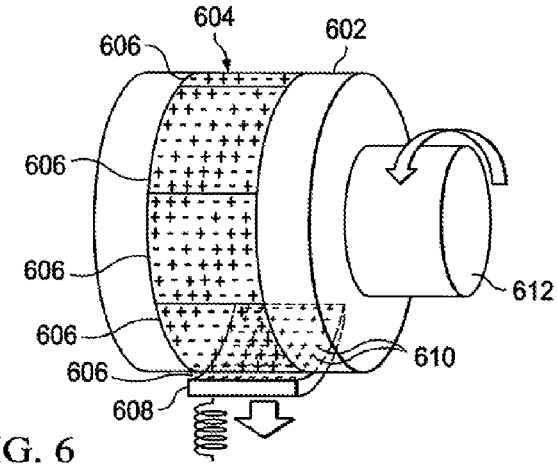
Figure 7B:
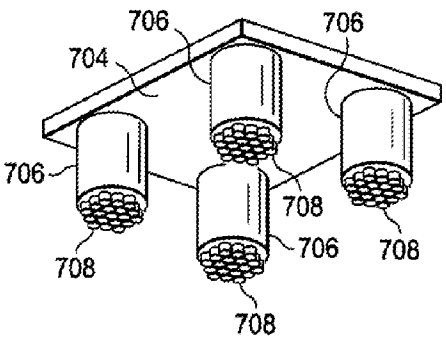
FIG. 7A-FIG. 7D illustrate an exemplary 2-D electromagnetics table.
Figure 7A:
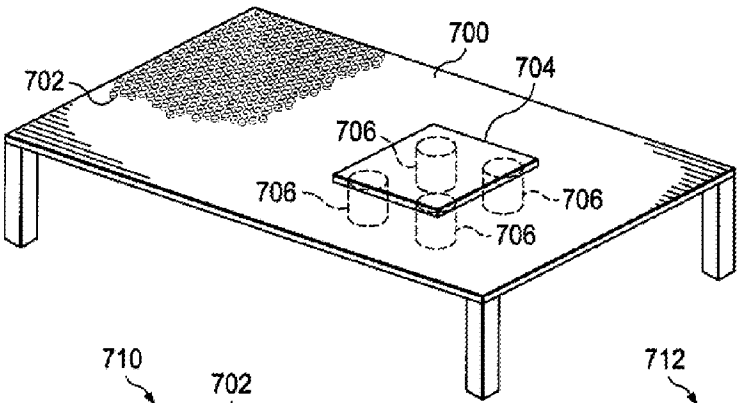
Figure 7D:
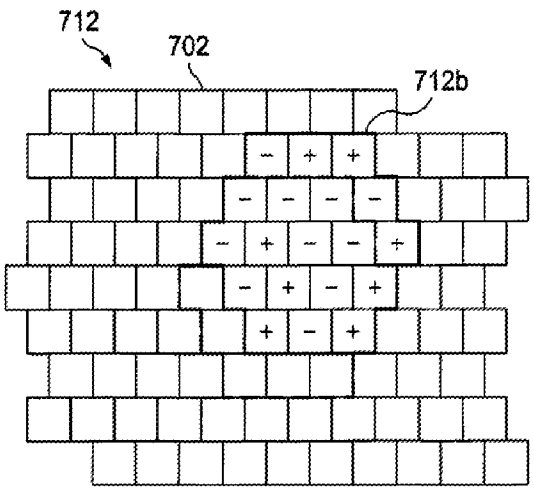
Figure 7C:
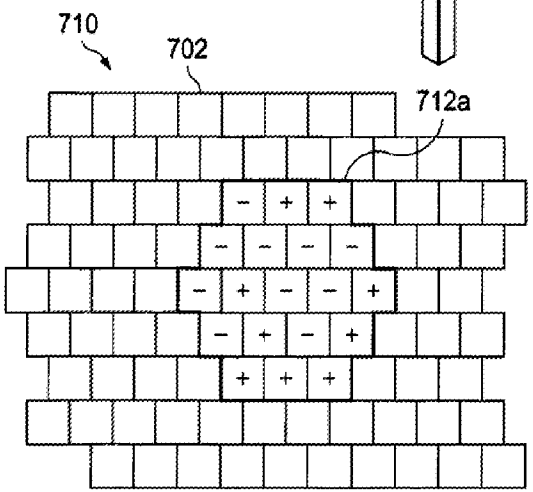

FIG. 6 is a diagram depicting an exemplary cylinder 602 having wrapped thereon a first magnetic field emission structure 604 with a code pattern 606 that is repeated six times around the outside of the cylinder 602. Beneath the cylinder 602 is an object 608 having a curved surface with a slightly larger curvature than the cylinder 602 and having a second magnetic field emission structure 610 that is also coded using the code pattern 606. Assume, the cylinder 602 is turned at a rotational rate of 1 rotation per second by shaft 612. Thus, as the cylinder 602 turns, six times a second the first magnetic field emission structure 604 on the cylinder 602 aligns with the second magnetic field emission structure 610 on the object 608 causing the object 608 to be repelled (i.e., moved downward) by the peak spatial force function of the two magnetic field emission structures 604 and 610. Similarly, had the second magnetic field emission structure 610 been coded using a code pattern that mirrored code pattern 606, then 6 times a second the first magnetic field emission structure 604 of the cylinder 602 would align with the second magnetic field emission structure 610 of the object 608 causing the object 608 to be attracted (i.e., moved upward) by the peak spatial force function of the two magnetic field emission structures 604 and 610. Thus, the movement of the cylinder 602 and the corresponding first magnetic field emission structure 604 can be used to control the movement of the object 608 having its corresponding second magnetic field emission structure 610. The cylinder 602 may be connected to a shaft 612 which may be turned as a result of wind turning a windmill, a water wheel or turbine, ocean wave movement, and other methods whereby movement of the object 608 can result from some source of energy scavenging. As such, correlated magnets enables the spatial forces between objects to be precisely controlled in accordance with their movement and also enables the movement of objects to be precisely controlled in accordance with such spatial forces.

In the above examples, the correlated magnets 304, 306, 402, 406, 502, 508, 604 and 610 overcome the normal 'magnet orientation' behavior with the aid of a holding mechanism such as an adhesive, a screw, a bolt & nut, etc. . . . . In other cases, magnets of the same magnetic field emission structure could be sparsely separated from other magnets (e.g., in a sparse array) such that the magnetic forces of the individual magnets do not substantially interact, in which case the polarity of individual magnets can be varied in accordance with a code without requiring a holding mechanism to prevent magnetic forces from 'flipping' a magnet. However, magnets are typically close enough to one another such that their magnetic forces would substantially interact to cause at least one of them to 'flip' so that their moment vectors align but these magnets can be made to remain in a desired orientation by use of a holding mechanism such as an adhesive, a screw, a bolt & nut, etc. . . . . As such, correlated magnets often utilize some sort of holding mechanism to form different magnetic field emission structures which can be used in a wide-variety of applications like, for example, a turning mechanism, a tool insertion slot, alignment marks, a latch mechanism, a pivot mechanism, a swivel mechanism, a lever, a drill head assembly, a hole cutting tool assembly, a machine press tool, a gripping apparatus, a slip ring mechanism, and a structural assembly.

C. Correlated Electromagnetics

Correlated magnets can entail the use of electromagnets which is a type of magnet in which the magnetic field is produced by the flow of an electric current. The polarity of the magnetic field is determined by the direction of the electric current and the magnetic field disappears when the current ceases. Following are a couple of examples in which arrays of electromagnets are used to produce a first magnetic field emission structure that is moved over time relative to a second magnetic field emission structure which is associated with an object thereby causing the object to move.

FIG. 7A-FIG. 7D illustrate a 2-D correlated electromagnetics example in which there is a table 700 having a two-dimensional electromagnetic array 702 (first magnetic field emission structure 702) beneath its surface and a movement platform 704 having at least one table contact member 706. In this example, the movement platform 704 is shown having four table contact members 706 each having a magnetic field emission structure 708 (second magnetic field emission structures 708) that would be attracted by the electromagnetic array 702. Computerized control of the states of individual electromagnets of the electromagnet array 702 determines whether they are on or off and determines their polarity. A first example 710 depicts states of the electromagnetic array 702 configured to cause one of the table contact members 706 to attract to a subset 712*a* of the electromagnets within the magnetic field emission structure 702. A second example 712 depicts different states of the electromagnetic array 702 configured to cause the one table contact member 706 to be attracted (i.e., move) to a different subset 712*b* of the electromagnets within the field emission structure 702. Per the two examples, the table contact member(s) 706 can be moved about table 700 by varying the states of the electromagnets of the electromagnetic array 702.

Figure 8:
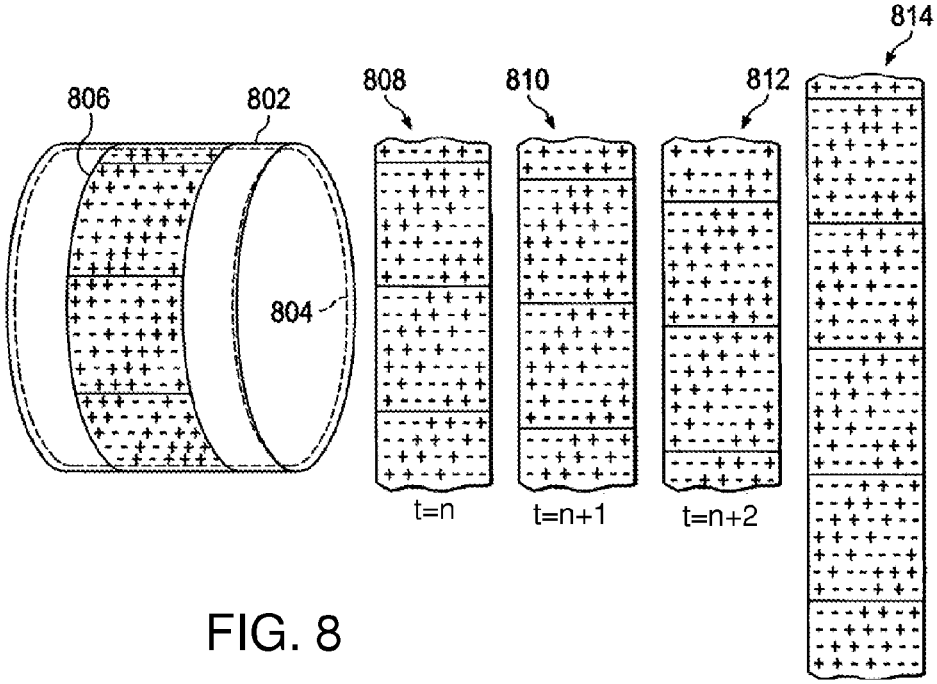

FIG. 8 illustrates an exemplary 3-D correlated electromagnetics example where there is a first cylinder 802 which is slightly larger than a second cylinder 804 that is contained inside the first cylinder 802. A magnetic field emission structure 806 is placed around the first cylinder 802 (or optionally around the second cylinder 804). An array of electromagnets (not shown) is associated with the second cylinder 804 (or optionally the first cylinder 802) and their states are controlled to create a moving mirror image magnetic field emission structure to which the magnetic field emission structure 806 is attracted so as to cause the first cylinder 802 (or optionally the second cylinder 804) to rotate relative to the second cylinder 804 (or optionally the first cylinder 802). The magnetic field emission structures 808, 810, and 812 produced by the electromagnetic array on the second cylinder 804 at time t=n, t=n+1, and t=n+2, show a pattern mirroring that of the magnetic field emission structure 806 around the first cylinder 802. The pattern is shown moving downward in time so as to cause the first cylinder 802 to rotate counterclockwise. As such, the speed and direction of movement of the first cylinder 802 (or the second cylinder 804) can be controlled via state changes of the electromagnets making up the electromagnetic array. Also depicted in FIG. 8 there is an electromagnetic array 814 that corresponds to a track that can be placed on a surface such that a moving mirror image magnetic field emission structure can be used to move the first cylinder 802 backward or forward on the track using the same code shift approach shown with magnetic field emission structures 808, 810, and 812 (compare to FIG. 5).

Figure 9:
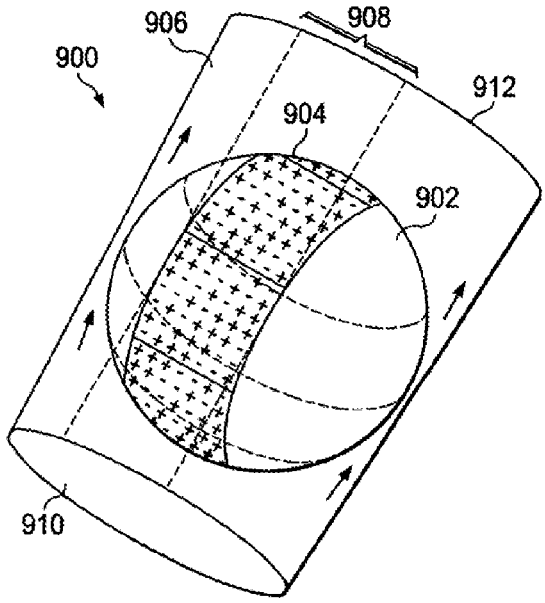

FIG. 9 illustrates an exemplary valve mechanism 900 based upon a sphere 902 (having a magnetic field emission structure 904 wrapped thereon) which is located in a cylinder 906 (having an electromagnetic field emission structure 908 located thereon). In this example, the electromagnetic field emission structure 908 can be varied to move the sphere 902 upward or downward in the cylinder 906 which has a first opening 910 with a circumference less than or equal to that of the sphere 902 and a second opening 912 having a circumference greater than the sphere 902. This configuration is desirable since one can control the movement of the sphere 902 within the cylinder 906 to control the flow rate of a gas or liquid through the valve mechanism 900. Similarly, the valve mechanism 900 can be used as a pressure control valve. Furthermore, the ability to move an object within another object having a decreasing size enables various types of sealing mechanisms that can be used for the sealing of windows, refrigerators, freezers, food storage containers, boat hatches, submarine hatches, etc., where the amount of sealing force can be precisely controlled. Many different types of seal mechanisms that include gaskets, o-rings, and the like can be employed with the use of the correlated magnets. The magnetic field emission structures can have an array of sources including, for example, a permanent magnet, an electromagnet, an electret, a magnetized ferromagnetic material, a portion of a magnetized ferromagnetic material, a soft magnetic material, or a superconductive magnetic material, or a combination thereof.

Defining Magnetic Structures Using Combinations of Codes

In accordance with the present invention, a plurality of codes is used to define magnetic source characteristics of a plurality of portions of a magnetic structure. Under one arrangement, a first plurality of codes is used to define magnetic source characteristics of a plurality of portions of a first magnetic structure and a second plurality of codes is used to define magnetic source characteristics of a plurality of portions of a second magnetic structure, where the first and second pluralities of codes may be complementary (i.e., mirror images). The possible combinations of the magnetic sources of the portions of the two magnetic structures produce magnetic forces that are in accordance with a spatial force function corresponding to the possible alignment combinations of the first plurality of codes and the second plurality of codes and thus the possible alignment combinations of the magnetic sources having characteristics defined by the first and second plurality of codes. As such, the correlation functions of the codes that define the characteristics of the magnetic sources that make up the magnetic structures combine to produce a combinatory correlation function when the portions of the magnetic structure collaborate over a given translational and/or rotational range of movement. The range of movement may be one-dimensional or multi-dimensional, and movement of either magnetic structure may be constrained or not constrained. For example, the relative movement of two magnetic structures may be constrained to up-down movement, side-to-side movement, full rotation about an axis, partial rotations about an axis, and so on. Portions of magnetic structures can also be constrained yet configured to move independently from one another. By combining different codes, many magnetic force characteristics can be produced whereby tensile force characteristics, shear force characteristics, torque characteristics, and relative movement characteristics can be controlled, and deficiencies in correlation characteristics of the individual codes can even be overcome.

A range of movement of the coded portions of two magnetic structures may typically be determined over some relative distance and/or rotation (i.e., degrees rotation) and the correlation functions of each of the codes used to define the magnetic sources in the portions of the magnetic structures can be mapped to that range of movement. As such, the correlation functions combine (add and subtract forces) over the range of movement to produce a spatial force function that is a composite of the correlation functions of the combination of codes corresponding to the portions of the two magnetic structures. The range of movement may be one-dimensional, two-dimensional, or three-dimensional and may, for example, correspond to a straight line, a curved line, an arc, a plane, a three dimensional surface, or a three-dimensional contour across such a surface. The magnetic sources employed in the invention may be permanent magnetic sources but they can also be electromagnets, electro-permanent magnets, or combinations thereof. As such, the correlation functions of one or more codes making up a code combination may vary dynamically in time (i.e., a fourth dimension). Moreover, the range of movement may itself move such as from one location to another across an array of electromagnets or electro-permanent magnets under programmatic control. Permanent magnetic sources may be discrete magnets or may be magnetized into magnetizable material (e.g., magnetically printed).

Additionally, although the exemplary code combinations provided herein involve polarity patterns where the magnetic field strengths can be considered to be the same for each magnetic source, many coding techniques can be employed that vary different attributes of the magnetic sources such as magnetic source size, shape, overlapping, depth, magnetic field strength, spatial frequency, and the like. Generally, any attribute of a magnetic source, such as the magnetization direction of a printed magnetic source (i.e., maxel) (a maxel is a magnetic pixel, or simply a magnetic element) can be varied in accordance with one or more codes. In this disclosure, embodiments described in relation to maxels may be implemented using discrete magnets, magnetized portions of continuous magnet material, or other magnetic field sources and vice versa. Barker codes, which have desirable autocorrelation properties, are used for several of the examples provided herein, but many other coding patterns can also be used in accordance with the invention.

One interesting aspect of combinational coding of complementary magnetic structures is that complementary (i.e., mirror image) polarity patterns can be applied to either of two structures to produce the same combinatory correlation function, but which one of the two complementary polarity patterns is applied to a given portion can be selected to take into account adjoining portion polarity patterns so as to affect code density (i.e., polarity changes per unit area) and therefore increase shunting (i.e., shortest path) effects between magnetic sources so as to affect shear forces and/or force vs. separation distance curves of the two structures.

Furthermore, although autocorrelation characteristics between two complementary magnetic structures are most often described in accordance with the invention, the cross-correlation characteristics of two structures each having multiple portions coded in accordance with multiple codes can be similarly assessed whereby cross-correlation functions can be combined in the same manner as autocorrelation functions.

Figure 10A:
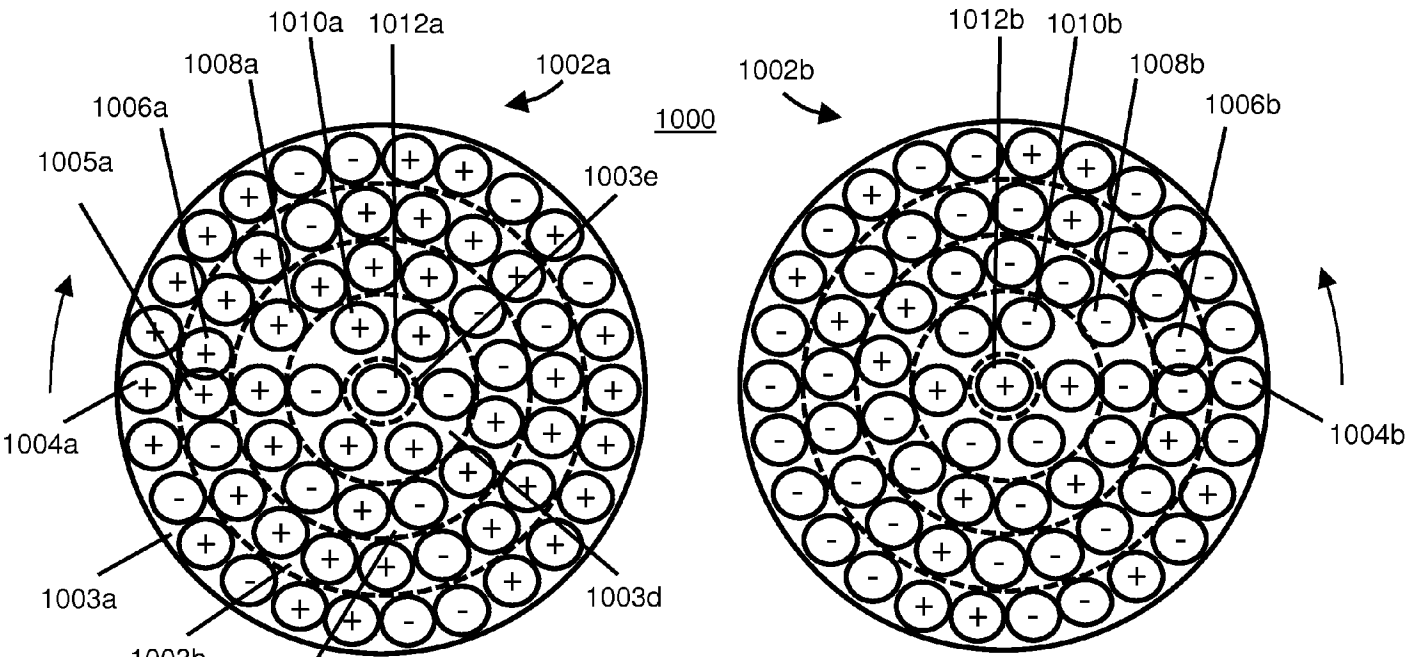
FIG. 10A depicts an exemplary magnetic system of two complementary magnetic structures comprising concentric circles of magnetic sources where the four complementary concentric circles are implemented with different combinations of Barker code modulos.

FIG. 10A depicts an exemplary magnetic system 1000 of two complementary magnetic structures 1002*a* 1002*b* comprising concentric circles of magnetic sources where the four complementary concentric circles are implemented with different combinations of Barker code modulos. As such, the four concentric circles of magnetic sources correspond to four different portions 1003*a*-1003*d* of each of the magnetic structures as indicated by the dashed lines and as labeled. The magnetic sources of the two magnetic structures will substantially correlate and achieve a peak attractive force when the structures are facing each other such that complementary coded magnetic sources are rotationally and translationally aligned. Referring to FIG. 10A, the first magnetic structure 1002*a* and second magnetic structure 1002*b* each have four concentric circles of positive and negative magnetic sources as indicted by the smaller circles having either a '+' or '−' sign inside them. The innermost concentric circles of magnetic sources of the two magnetic structures each surround a single magnetic source. As such, the single magnetic sources at the centers of the magnetic structures can be considered residing in fifth portions 1003*e* of each of the two magnetic structures 1002*a* 1002*b*. Each one of the four concentric circles of magnetic sources of the first magnetic structure 1002*a* has complementary coding to a corresponding one of the four concentric circles of magnetic sources of the second magnetic structure 1002*b* and the polarity of the single magnetic sources at the two centers is also complementary. The outermost circles each comprise 26 magnetic sources, or maxels, coded using two Barker 13 code modulos. For the first magnetic structure 1002*a*, the two Barker 13 code modulos begin with a first positive maxel 1004*a* and continue clockwise around the outermost circle. Similarly, for the complementary coded second magnetic structure 1002*b*, the two Barker 13 code modulos begin with a first negative maxel 1004*b* and continue counterclockwise around the outermost circle. As such the outermost circle of the first magnetic structure 1002*a* has two modulos (or instances) of the Barker 13 code + + + + + − − + + − + + − + and the outermost circle of the second magnetic structure 1002*b* has two modulos of a complementary Barker 13 code − − − − − + + − − + − + −. Similarly, the next concentric circles (moving inward toward the center) of the two magnetic structures has four code modulos of complementary Barker 5 codes beginning with a positive maxel 1006*a* and coding clockwise with the first magnetic structure 1002*a* and with a negative maxel 1006*b* and coding counterclockwise with the second magnetic structure, where the complementary Barker 5 coded maxel patterns are + + + − + and − − − + −, respectively. It should be noted that the first maxel of the first code modulo 1006*a* and the last maxel of the fourth code modulo 1005*a* overlap. This overlapping was provided for example purposes but generally, the spacing between maxels can be selected and such things as maxel overlapping can be taken into account when determining the correlation functions between two coded magnetic structures or portions of magnetic structures. This same coding approach can be seen for the next two concentric circles which are coded in accordance with individual code modulos of complementary Barker 13 coded maxel patterns beginning at maxels 1008*a* and 1008*b* and two modulos of complementary Barker 3 coded maxel patterns (+ + − and − − +) beginning at respective positive and negative maxels 1010*a* 1010*b*. The centermost maxels 1012*a* 1012*b* are also complementary and may provide a bias attractive force given the two magnetic structures are constrained to rotate about a central axis whereby the two maxels will always be in an attractive alignment with each other.

Figure 10B:
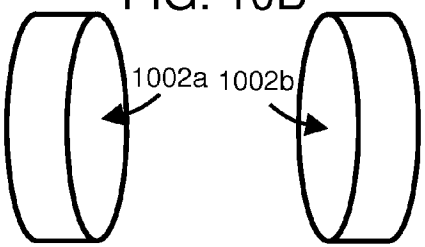
FIG. 10B depicts the two complementary magnet structures of FIG. 10A rotated in a direction facing one another; when fully rotated to contact, the magnetic force function may be fully developed.
Figure 10C:
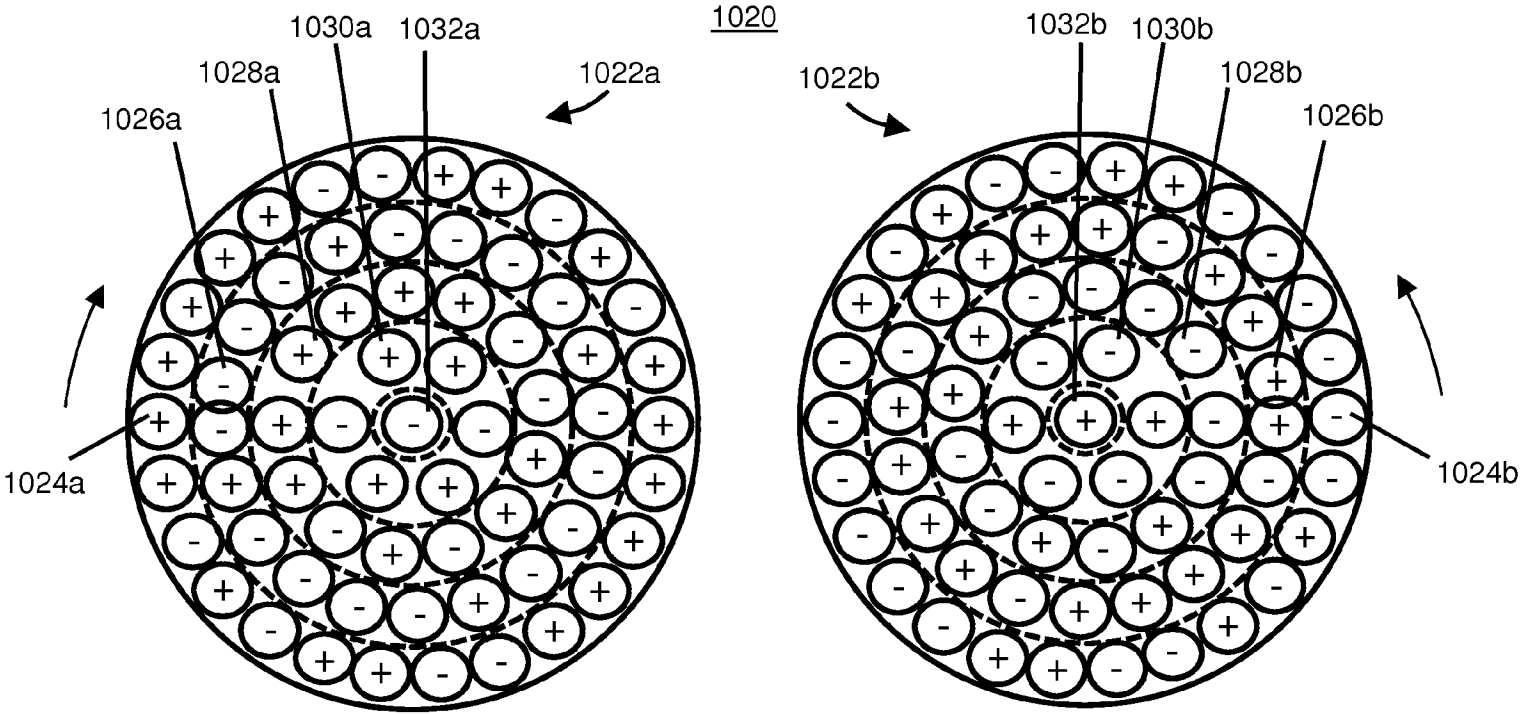
FIG. 10C depicts an exemplary magnetic system that is the same as the magnetic system of FIG. 10A except the polarities of the magnetic sources of the second concentric circle are reversed.

FIG. 10C depicts an exemplary magnetic system 1020 that is the same as the magnetic system 1000 of FIG. 10A except the polarities of the magnetic sources of the second concentric circle are reversed. By comparing FIGS. 10A and 10C it can be seen that the coding of the outermost and two innermost concentric circles is identical but that the polarities of the magnetic sources of the other concentric circle are reversed. Specifically, the first magnetic structure 1022*a* of FIG. 10C has a first negative maxel 1026*a* of the first of four modulos of the Barker 5 coded maxel pattern − − − + − coded in a clockwise manner is opposite the polarity of the first positive maxel 1006*a* of the first of four modulos of the Barker 5 coded maxel pattern + + + − + of the first magnetic structure 1002*a* of FIG. 10A. Similarly, the polarities of the complementary concentric circles of the second magnetic structures of the two magnetic systems 1000 and 1020 are reversed in polarity. As such, the combined correlation functions of the two magnetic systems 1000 1020 is the same yet other field and force characteristics are affected by the reversing of the polarities of the Barker 5 code modulos. Again, by comparing the two magnetic systems 1000 1020 it can be seen that the first magnetic structure 1002*a* of the magnetic system 1000 of FIG. 10A contains a much greater number of positive maxels than negative, and similarly the second magnetic structure 1002*b* comprises a much greater number of negative maxels than positive. As such, in the far field, the first magnetic structure 1002*a* will generally produce a positive magnetic field while the second magnetic structure 1002*b* will generally produce a negative magnetic field. In contrast, because the coding of the magnetic sources of the second concentric circle have been reversed in the magnetic system 1020 of FIG. 10B, the number of positive and negative maxels is more equal which translates to the magnetic fields canceling more in the far field. Furthermore, by reversing the polarities, a greater code density is achieved thereby increasing shunting effects which increases overall shear force strength and generally produces a greater concentration of magnetic flux into the near field instead of the far field due to shunting effects.

Figure 11A:
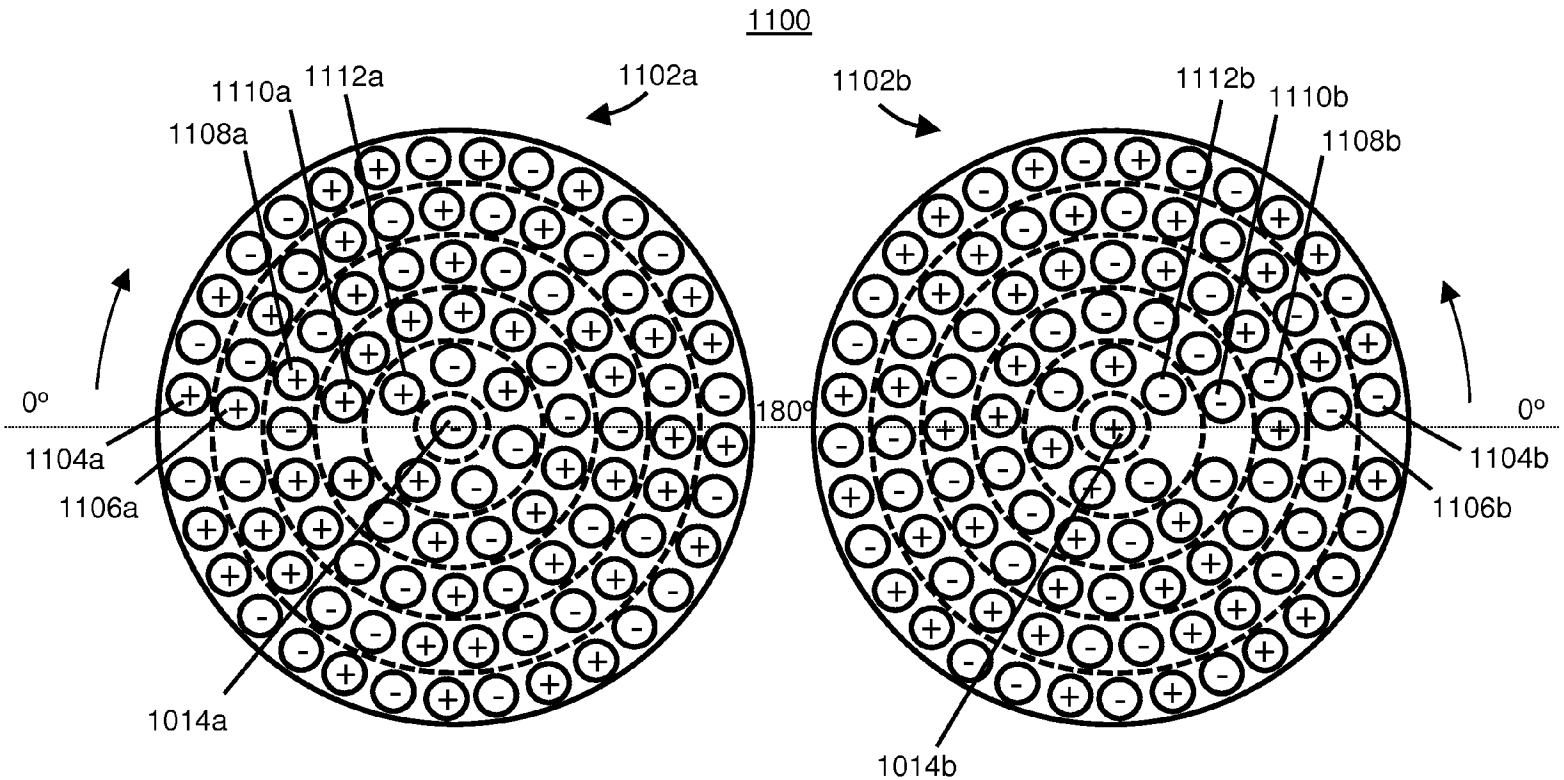
FIG. 11A depicts an exemplary magnetic system of two complementary magnetic structures comprising concentric circles of magnetic sources where the five complementary concentric circles comprise different combinations of Barker code modulos implemented with symbols that correspond to complementary patterns of magnetic sources.

FIG. 11A depicts an exemplary magnetic system 1100 of two complementary magnetic structures 1102*a* 1102*b* comprising five concentric circles of magnetic sources where the five complementary concentric circles comprise different combinations of Barker code modulos implemented with symbols that correspond to complementary patterns of magnetic sources. Referring to FIG. 11A, the outermost concentric circles each comprise four Barker 4 coded patterns + + − + and − − + − where the + and − code elements, which represent polarities of individual magnetic sources, are replaced with symbols to represent polarities of two magnetic sources. Specifically, each + code element is replaced with the symbol +− and each − code element is replaced with the symbol − +. Thus, the two Barker 4 code patterns become + − + − − + + − and − + − + + − − +, respectively. The use of symbols is a nested form of combinatory coding whereby a symbol could be any code including multiple nested codes (symbols within symbols, etc.). Moreover, a given symbol can be multiple code modulos. For example, a Barker 4 code + + − + might be implemented using symbols corresponding to two Barker 3 code modulos + + − + + − and − − + − − +, which corresponds to a pattern of + + − + + − + + +− + + − − − + − − + + + − + + −. Thus, again referring to FIG. 11A, the outermost concentric circles correspond to four modulos of Barker 4 coded patterns implemented using +− and −+ symbols beginning with positive and negative maxels 1104*a* 1104*b*, respectively. The next concentric circles (inward towards the center) each comprise one code modulo of a Barker 13 coded pattern implemented with the same symbols as the outermost circle beginning with positive and negative maxels 1106*a* and 1106*b*, respectively. The next two concentric circles each have two code modulos of a Barker 5 coded pattern also implemented with the same symbols beginning with maxels 1108*a* and 1108*b*. The fourth concentric circles each have one code modulo of a Barker 13 coded pattern implemented with single maxel symbols + and − beginning with maxels 1110*a* and 1110*b*, respectively, and the fifth concentric circles each have one code modulo of a Barker 3 coded pattern implemented with the two maxel symbols used with the outermost circle beginning with maxels 1112*a* and 1112*b*, respectively. The two center maxels 1014*a* and 1014*b* of the two magnetic structures 1102*a* 1102*b* act as bias magnetic sources as previously described in relation to FIGS. 10A and 10B.

Two interesting combinations of Barker codes involve nesting of multiple Barker codes having all the possible Barker code lengths (i.e., 13, 11, 7, 5, 4, 3, 2), where either of the two forms of Barker 4 codes can be used (i.e., 4a=+ + − + and 4b=+ + + −) and only the + − form of Barker 2 codes is used. Such codes could be defined as Barker 13(Barker 11(Barker 7(Barker 5(Barker 4a(Barker 3(Barker 2)))))) and Barker 13(Barker 11(Barker 7(Barker 5(Barker 4b(Barker 3(Barker 2))))). As described previously, complementary codes can be employed at any given nesting level. For example, the Barker 13 level can be either + + + + + − + + − + − + or − − − − − ++− − + − + − and then, for each + or − symbol of either Barker 13 implementation, the Barker 11 level can be either + + + − − − + − − + − or − − − + + + − + + − + and, so on. As such, many possible nesting combinations can be employed in translational and/or rotational implementations. And, for a given nested code combination of multiple Barker codes as implemented there is a corresponding complementary (i.e., mirror image) nested code combination. Such code nesting can also be implemented using codes other than Barker codes and using combinations of Barker codes and other codes.

Referring to FIGS. 10A, 10B, and 11A, it can be noted that the spacing between maxels can be substantially uniform or non-uniform. Magnetic structures can also be implemented whereby there even larger gaps of non-magnetized ferromagnetic material in between maxels that can bias correlation functions. Maxel spacing and relative maxel alignment between different portions of magnetic structures determines how the individual correlation functions map to a spatial layout and how the various correlation functions combine. With concentric circle code combinations, there is a phase relationship between the various codes of the concentric circles that is based on where the code modulos begin and end. For example, if each of the maxels in each of the five concentric circles shown in FIG. 11A were uniformly spaced (for a given circle) and each of the various patterns of code modulos began with maxels centered on the dotted 0° reference line, then the various codes would be synchronized and have a far different phase relationship and magnetic behavior than they will have as currently depicted.

Figure 11B:
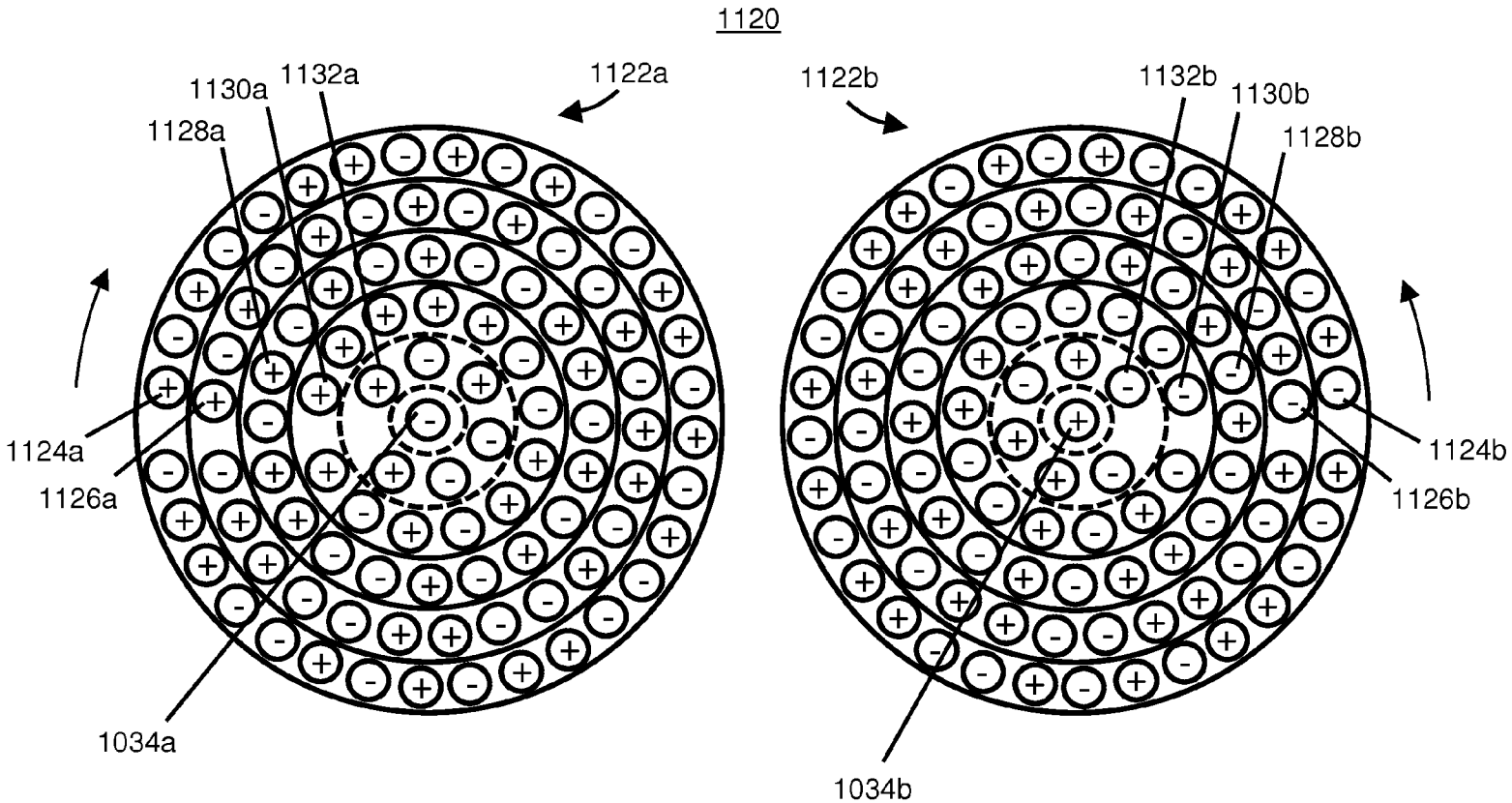
FIG. 11B depicts an exemplary magnetic system having the same coding as the system of FIG. 11A except the three outer concentric circles are configured to be able to rotate independent of each other.

FIG. 11B depicts an exemplary magnetic system 1120 having the same coding as the system of FIG. 11A except the three outer concentric circles are configured to be able to rotate independent of each other. As such, the phase relationship between the codes of the various portions of the magnetic system 1120 can be varied by rotating one or more of the three outer concentric circles.

Figure 12:
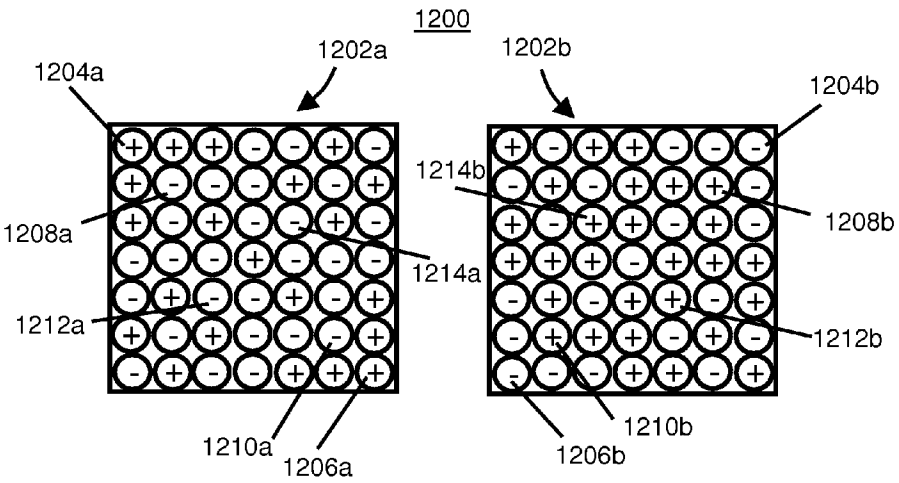
FIG. 12 depicts an exemplary magnetic system of two complementary magnetic structures comprising magnetic sources arrayed in columns and rows and coded in accordance with overlapping Barker codes.

FIG. 12 depicts an exemplary magnetic system 1200 of two complementary magnetic structures 1202*a* 1202*b* comprising magnetic sources arrayed in columns and rows and coded in accordance with overlapping Barker codes. Specifically, the first magnetic structure 1202 comprises two horizontal and two vertical Barker 7 coded patterns that overlap in each of the four corners. As such, Barker 7 coded patterns + + + − − + − begin at maxel 1204*a* and traverse both to the right horizontally and vertically downward. Similarly, the same patterns beginning at maxel 1206*a* and traverse both to the left horizontally and vertically upward where again the maxels of the four Barker 7 patterns intersect at the four corners. As such, the four Barker 7 coded patterns form a square. The same approach was used to produce four complementary Barker 7 coded patterns to form a square in the outermost portion of the second magnetic structure 1202*b*. Within the Barker 7 coded squares of the magnetic structures 1202*a* 1202*b* are Barker 5 coded squares produced where the starting maxels are 1208*a* 1210*a* and 1208*b* 1210*b*, respectively. Inside the Barker 5 coded squares are Barker 3 coded squares where the starting maxels are 1212*a* 1214*a* and 1212*b* 1214*b*, respectively. Inside the Barker 3 coded squares are single positive and negative maxels. One may observe that the two magnetic structures 1202*a* 1202*b* will fully correlate the same in two 180° orientations (i.e., either structure can be rotated) 180°. Furthermore, the two structures will also have the same correlation when rotated 90° and 270° relative to each other, although peak correlation will not be achieved due to cancellation of magnetic forces.

Figure 13:
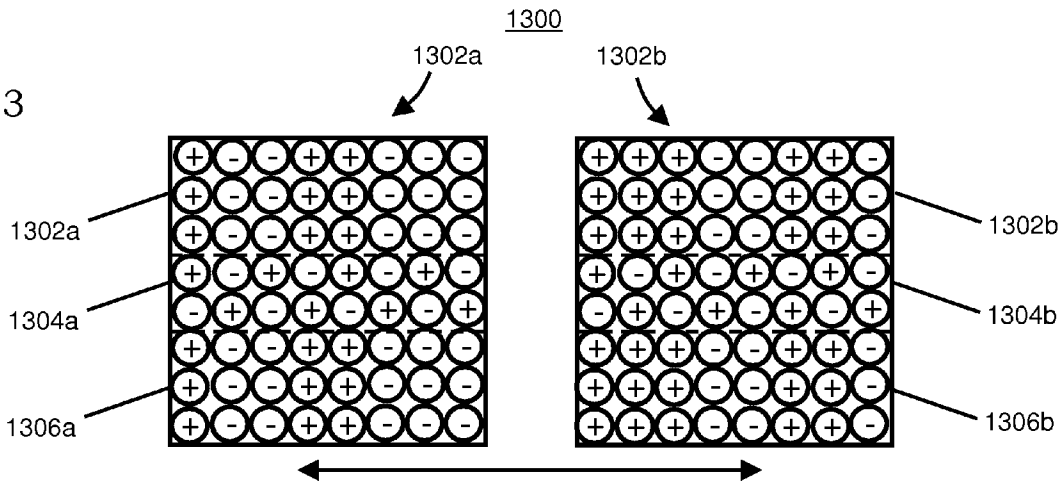
FIG. 13 depicts an exemplary magnetic system of two complementary magnetic structures comprising magnetic sources arrayed in columns and rows subdivided into three regions where two outer regions are coded to produce movement characteristics and the innermost regions are coded to achieve desirable shear force characteristics.

FIG. 13 depicts an exemplary magnetic system 1300 of two complementary magnetic structures 1302*a* 1302*b* comprising magnetic sources arrayed in columns and rows subdivided into three regions 1302*a*, 1304*a*, 1306*a* and 1302*b*, 1304*b*, 1306*b*, where the two outer regions 1302*a* 1306*a* and 1302*b* 1306*b* are coded to produce movement characteristics and the innermost regions 1304*a* and 1304*b* are coded to achieve desirable shear force characteristics. The two complementary structures are designed to be constrained such that the two structures can only move along the length of the coded regions (i.e., left to right and vice versa as depicted).

FIG. 14A1 and 14A2 depict an exemplary magnetic system 1400 of two complementary magnetic structures 1402*a* 1402*b* comprising one-dimensional arrays of magnetic sources coded in accordance with a code having a peak force to maximum off peak force ratio of 2.5. As the first magnetic structure 1402*a* moves across the second magnetic structure 1402*b* the nine relative alignments produce a correlation function of −1 0 1 2 5 2 10 −1, where the peak force is 5 and maximum off peak force is 2. The peak force to maximum off peak force ratio equals ABS(5/2) or 2.5.

FIG. 14A2 is a table showing the steps of the calculation of the autocorrelation value. Column "P" is the position number from 1 to 9. Column V is the correlation or force value. Column "Pattern" shows the overlay pattern at that shift value.

FIG. 14B1 and FIG. 14B2 depict an exemplary magnetic system 1403 of two complementary magnetic structures 1404*a* 1404*b* comprising one-dimensional arrays of magnetic sources coded in accordance with a code having a peak force to maximum off peak force ratio of 1.67. As the first magnetic structure 1404*a* moves across the second magnetic structure 1404*b* the nine relative alignments produce a correlation function of 1 0 −3 0 5 0 −3 0 1, where the peak force is 5 and maximum off peak force is −3. The peak force to maximum off peak force ratio equals ABS(5/−3) or 1.67.

FIG. 14B2 is a table showing the steps of the calculation of the autocorrelation value. Column "P" is the position number from 1 to 9. Column V is the correlation or force value. Column "Pattern" shows the overlay pattern at that shift value.

Figure 14C:
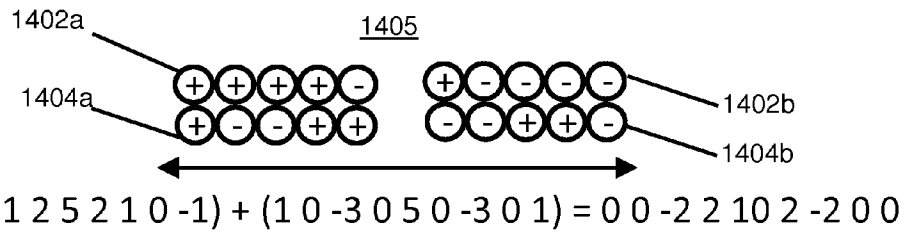
FIG. 14C depicts an exemplary magnetic system of two complementary magnetic structures produced by combining the one-dimensional arrays of magnetic sources of FIGS. 14A1 and 14B1 where the combination of the two coded arrays has a peak force to maximum off peak force ratio of 5.

FIG. 14C depicts an exemplary magnetic system 1405 of two complementary magnetic structures produced by combining the one-dimensional arrays of magnetic sources 1402*a* 1402*b* and 1404*a* 1404*b* of FIGS. 14A1 and 14B1, where the combination of the two coded arrays has a peak force to maximum off peak force ratio of 5. By constraining the combined arrays such that the first portion 1402*a* of the first magnetic structure aligns with the first portion 1402*b* of the second magnetic structure while in parallel the second portion 1404*a* of the first magnetic structure aligns with the second portion 1404*b* of the second magnetic structure the two correlation functions of the respective portions add to produce a combined correlation function of 0 0 −2 2 10 2 −2 0 0, where the peak force is 10 and maximum off peak force is 2 (or −2). The peak force to maximum off peak force ratio equals ABS(10/2) or ABS(10/−2) or 5.0. Thus, by combining two codes in parallel their combined autocorrelation properties can be a substantial improvement over their individual autocorrelation properties.

Figure 14D:
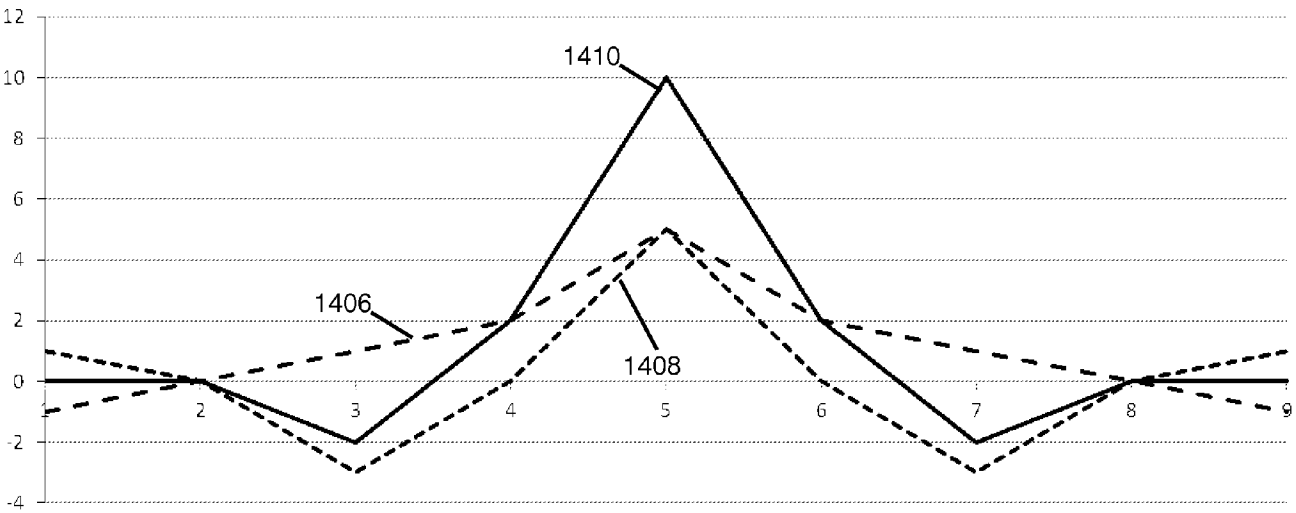
FIG. 14D depicts the correlation functions of the magnetic systems of FIGS. 14A1, 14B1 and 14C.

FIG. 14D depicts the correlation functions of the magnetic systems of FIGS. 14A1, 14B1 and 14C. Referring to FIG. 14D, a first correlation function 1406 corresponds to the magnetic system 1400 of FIG. 14A1 and a second correlation function 1408 corresponds to the magnetic system 1403 of FIG. 14B1. When the first and second correlation functions 1406 1408 are combined they produce a combined correlation function 1410, which has greatly improved autocorrelation characteristics than of the first and second correlation functions 1406 1408 individually.

FIG. 14E1 and FIG. 14E2 depict another exemplary magnetic system 1411 of two complementary magnetic structures 1412*a* 1412*b* comprising one-dimensional arrays of magnetic sources coded in accordance with a code having a peak force to maximum off peak force ratio of 2.5. As the first magnetic structure 1412*a* moves across the second magnetic structure 1412*b* the nine relative alignments produce a correlation function of −1 −2 −1 2 5 2 −1 −2 −1, where the peak force is 5 and maximum off peak force is 2 (or −2). The peak force to maximum off peak force ratio equals ABS(5/2) or ABS(5/−2) or 2.5.

FIG. 14E2 is a table showing the steps of the calculation of the autocorrelation value. Column "P" is the position number from 1 to 9. Column V is the correlation or force value. Column "Pattern" shows the overlay pattern at that shift value.

FIG. 14F1 and FIG. 14F2 depict yet another exemplary magnetic system 1413 of two complementary magnetic structures comprising one-dimensional arrays of magnetic sources coded in accordance with a code having a peak force to maximum off peak force ratio of 2.5. As the first magnetic structure 1414*a* moves across the second magnetic structure 1414*b* the nine relative alignments produce a correlation function of −1 2 −1 −2 5 −2 −1 2 −1, where the peak force is 5 and maximum off peak force is 2 (or −2). The peak force to maximum off peak force ratio equals ABS(5/2) or ABS(5/−2) or 2.5.

FIG. 14F2 is a table showing the steps of the calculation of the autocorrelation value. Column "P" is the position number from 1 to 9. Column V is the correlation or force value. Column "Pattern" shows the overlay pattern at that shift value.

Figure 14G:
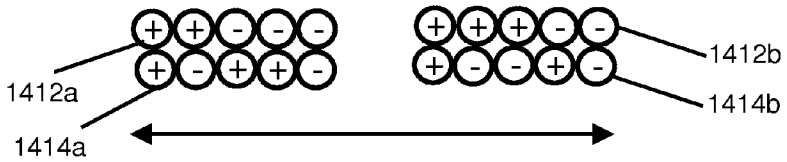
FIG. 14G depicts an exemplary magnetic system of two complementary magnetic structures produced by combining the one-dimensional arrays of magnetic sources of FIGS. 14E and 14F where the combination of the two coded arrays has a peak force to maximum off peak force ratio of 5.

FIG. 14G depicts another exemplary magnetic system 1415 of two complementary magnetic structures produced by combining the one-dimensional arrays of magnetic sources 1412*a* 1412*b* and 1414*a* 1414*b* of FIGS. 14E1 and 14F1 where the combination of the two coded arrays has a peak force to maximum off peak force ratio of 5. By constraining the combined arrays such that the first portion 1412*a* of the first magnetic structure aligns with the first portion 1412*b* of the second magnetic structure while in parallel the second portion 1414*a* of the first magnetic structure aligns with the second portion 1414*b* of the second magnetic structure, the two correlation functions of the respective portions add to produce a combined correlation function of 2 0 −2 0 10 0 −2 0 −2, where the peak force is 10 and maximum off peak force is 2 (or −2). The peak force to maximum off peak force ratio equals ABS(10/2) or ABS(10/−2) or 5.0. Thus, by combining two codes in parallel their combined autocorrelation properties can be a substantial improvement over their individual autocorrelation properties.

Figure 14H:
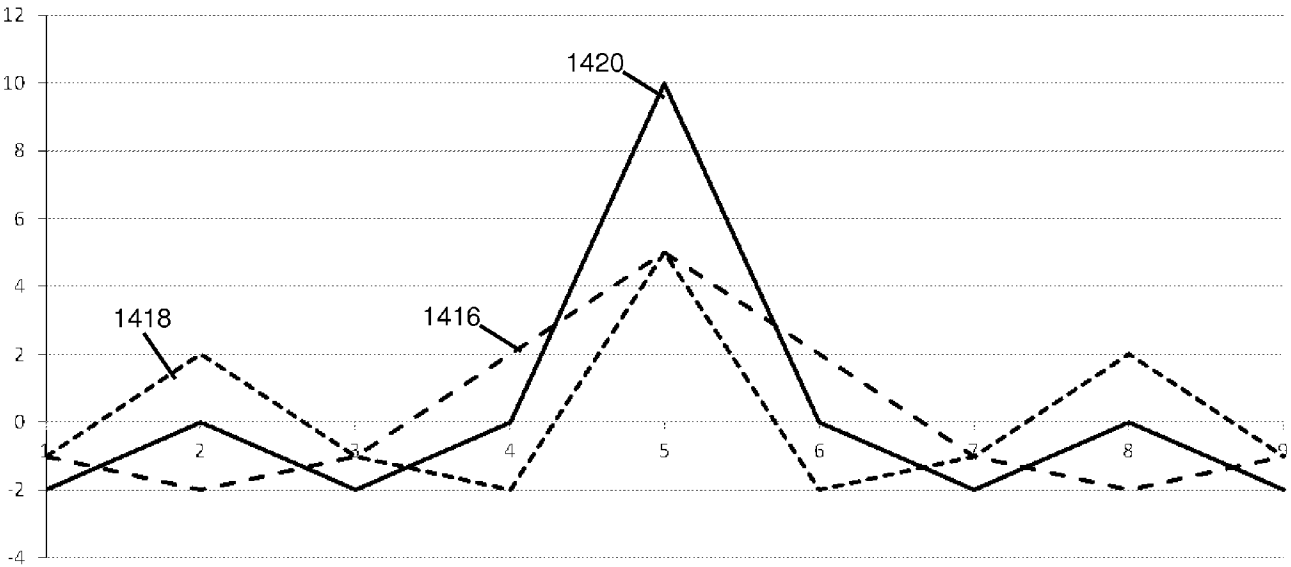
FIG. 14H depicts the correlation functions of the magnetic systems of FIGS. 14E1, 14F1 and 14G.

FIG. 14H depicts the correlation functions of the magnetic systems of FIGS. 14E1, 14F1 and 14G. Referring to FIG. 14H, a first correlation function 1416 corresponds to the magnetic system 1411 of FIG. 14E1 and a second correlation function 1418 corresponds to the magnetic system 1413 of FIG. 14F1. When the first and second correlation functions 1416 1418 are combined they produce a combined correlation function 1420, which has greatly improved autocorrelation characteristics than of the first and second correlation functions 1416 1418 individually.

FIG. 14I1 and FIG. 14I2 depict still another exemplary magnetic system 1421 of two complementary magnetic structures 1422*a* 1422*b* comprising one-dimensional arrays of magnetic sources coded in accordance with a code having a peak force to maximum off peak force ratio of 2.5. As the first magnetic structure 1422*a* moves across the second magnetic structure 1422*b* the nine relative alignments produce a correlation function of 1 −2 −1 0 5 0 −1 −2 1, where the peak force is 5 and maximum off peak force is −2. The peak force to maximum off peak force ratio equals ABS(5/−2) or 2.5.

FIG. 14I2 is a table showing the steps of the calculation of the autocorrelation value. Column "P" is the position number from 1 to 9. Column V is the correlation or force value. Column "Pattern" shows the overlay pattern at that shift value.

Figure 14J:
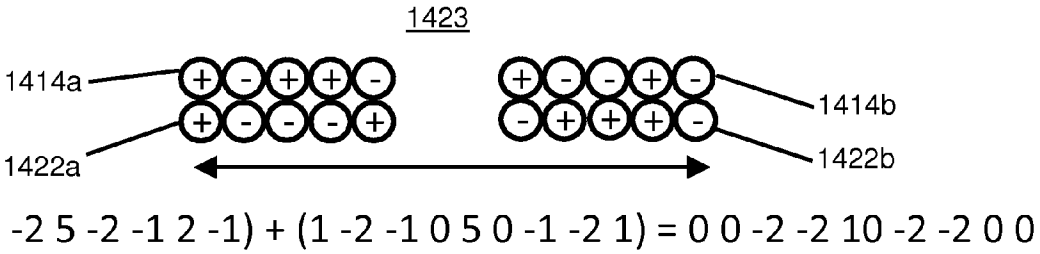
FIG. 14J depicts an exemplary magnetic system of two complementary magnetic structures produced by combining the one-dimensional arrays of magnetic sources of FIGS. 14F1 and 14I1 where the combination of the two coded arrays has a peak force to maximum off peak force ratio of 5.

FIG. 14J depicts yet another exemplary magnetic system 1423 of two complementary magnetic structures produced by combining the one-dimensional arrays of magnetic sources 1414*a* 1414*b* and 1422*a* 1422*b* of FIGS. 14F1 and 14I1 where the combination of the two coded arrays has a peak force to maximum off peak force ratio of 5. By constraining the combined arrays such that the first portion 1414*a* of the first magnetic structure aligns with the first portion 1414*b* of the second magnetic structure while in parallel the second portion 1422*a* of the first magnetic structure aligns with the second portion 1422*b* of the second magnetic structure, the two correlation functions of the respective portions add to produce a combined correlation function of 0 0 −2 −2 10 −2−2 0 0, where the peak force is 10 and maximum off peak force is −2. The peak force to maximum off peak force ratio equals ABS(10/−2) or 5.0. Thus, by combining two codes in parallel their combined autocorrelation properties are improved compared to their individual autocorrelation properties.

Figure 14K:
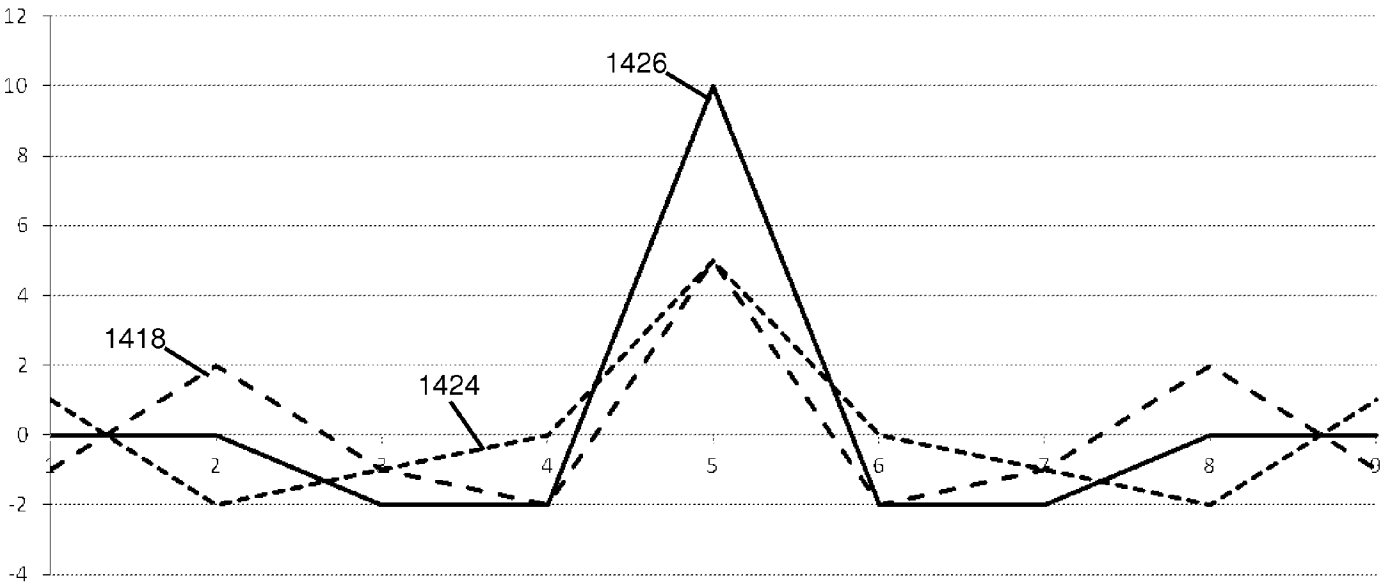
FIG. 14K depicts the correlation functions of the magnetic systems of FIGS. 14F1, 14I1 and 14J.

FIG. 14K depicts the correlation functions of the magnetic systems of FIGS. 14F1, 14I1 and 14J. Referring to FIG. 14K, a first correlation function 1418 corresponds to the magnetic system 1413 of FIG. 14F1 and a second correlation function 1424 corresponds to the magnetic system 1421 of FIG. 14I1. When the first and second correlation functions 1418 1421 are combined they produce a combined correlation function 1426, which has greatly improved autocorrelation characteristics than of the first and second correlation functions 1418 1421 individually.

FIG. 14L1, FIG. 14L2, and FIG. 14L3 depict the correlation of one of the magnetic structures 1402*a* 1404*a* of FIG. 14C with one of the magnetic structures 1412*a* 1414*a* of 14G where the peak force to maximum off peak force ratio is 1.5.

FIG. 14L2 and FIG. 14L3 are tables showing the steps of the calculation of the autocorrelation value. Column "P" is the position number from 1 to 9. Column V is the correlation or force value. Column "Pattern" shows the overlay pattern at that shift value.

By constraining the combined arrays such that the first portion 1402*a* of the first magnetic structure aligns with the first portion 1412*a* of the second magnetic structure while in parallel the second portion 1404*a* of the first magnetic structure aligns with the second portion 1414*a* of the second magnetic structure, the two correlation functions of the respective portions add to produce a combined correlation function of 2 0 2 6 −2 −4 −2 0 0, where the peak force is 6 and maximum off peak force is −4. The peak force to maximum off peak force ratio equals ABS(6/−4) or 1.5. One may observe that FIG. 14L1 provides an example of cross-correlation as opposed to autocorrelation. As such, the peak force to maximum off peak force, which is useful to compare autocorrelation properties, but is not useful for comparing cross-correlation. Instead, for cross-correlation it is desirable that all alignments have a low value relative to the peak force when either magnetic structure is achieves peak autocorrelation, when both structures would produce a peak force of 10. As such, it would be desirable, for example, that the peak force produced for all cross-correlation alignments is no more than some relatively smaller number, for example, 2. Under one arrangement, desirable cross correlation properties would involve 0 force produced for all alignments. Under another arrangement desirable, cross correlation properties would involve repel forces for all alignments. Under yet another arrangement, desirable cross correlation properties would involve only repel or zero forces for all alignments.

Figure 15A:
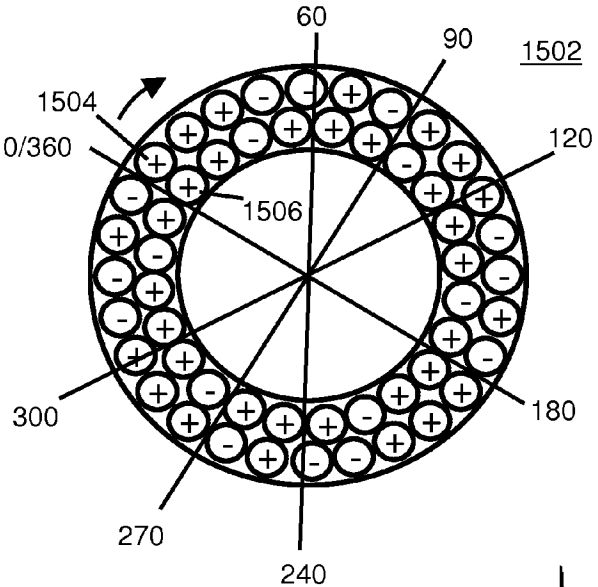
FIG. 15A depicts an exemplary magnetic structure comprising two concentric circles of magnetic sources where the outer circle has four Barker 7 code modulos and the inner circle has six Barker 4 code modulos.

FIG. 15A depicts an exemplary magnetic structure 1502 comprising two concentric circles of magnetic sources where the outer circle has four Barker 7 code modulos and the inner circle has six Barker 4 code modulos. The code modulos of the two concentric circles have relative positions that produce various force combinations as the magnetic structure is rotated relative to a complementary coded magnetic structure (not shown). Referring to FIG. 15A, the outermost circle has four Barker 7 code modulos beginning with maxel 1504 going clockwise around the circle as indicated by the arrow. As such, a new Barker 7 code modulo begins every 90°. The innermost circle has six Barker 4 code modulos beginning with maxel 1506 going clockwise around the circle such that a new Barker 4 code modulo begins every 60°.

Figure 15B:
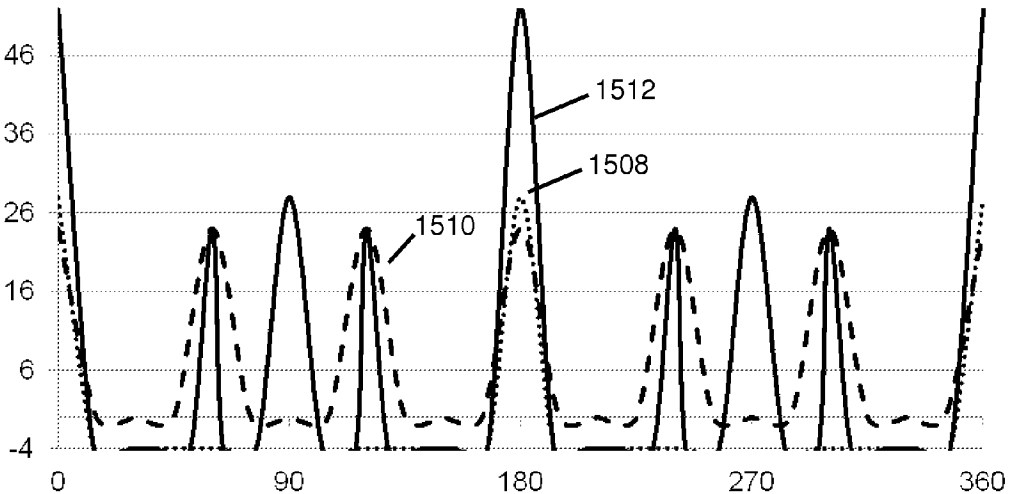
FIG. 15B depicts the correlation functions of each of the two concentric circles of magnetic sources and a combined correlation function.

FIG. 15B depicts the correlation functions 1508 1510 of each of the two concentric circles of magnetic sources and a combined correlation function 1512. Referring to FIG. 15B, the correlation function 1508 indicates that complementary outermost circles will produce a peak force of 28 every 90° and produce a repel force of −4 for positions in between 0° and 90°, between 90° and 180°, between 180° and 270°, and between 270° and 360°. Similarly, the correlation function 1510 indicates that complementary innermost circles will produce a peak force of 24 every 60° and produce a zero force for positions between 0° and 60°, between 60° and 120°, between 120° and 180°, between 180° and 240°, between 240° and 270°, between 270° and 330°, and between 330° and 360°. For 0° and 180° alignments the peak forces of the two correlation functions combine to produce a combined peak force of 52. Thus, the combined correlation function indicates peak forces of 52 at 0° and 180° alignments, off peak forces of 28 at 90° and 270° alignments, off peak forces of 24 and 60° alignments, 120°, 240°, and 330° alignments, and off peak forces of −4 at all other alignments.

Figure 16A:
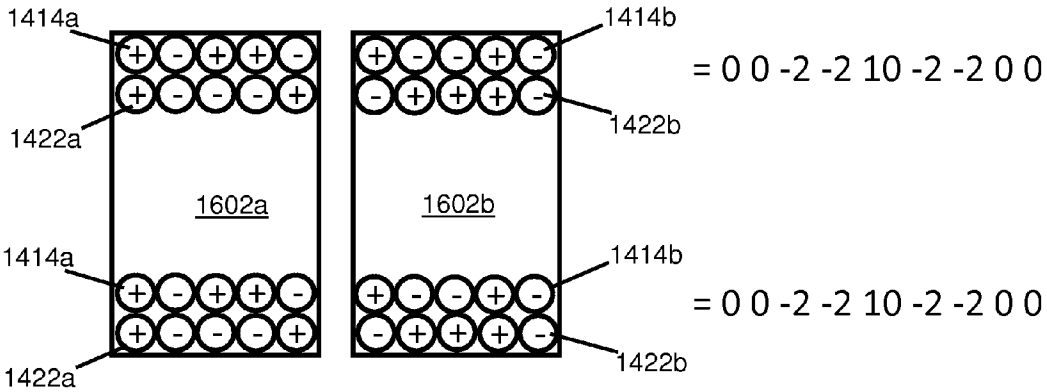
FIG. 16A depicts two objects each having two complementary coded magnetic structures having the same correlation functions arranged to maintain a first degree of balanced magnetic forces as one of the two objects moves past the other.

FIG. 16A depicts two objects 1602*a* 1602*b* each having two complementary coded magnetic structures having the same correlation functions arranged to maintain a first degree of balanced magnetic forces as one of the two objects moves past the other. Because the correlation functions are the same between the top and bottom complementary magnetic structures, the forces are the same as one object is moved across the other.

Figure 16B:
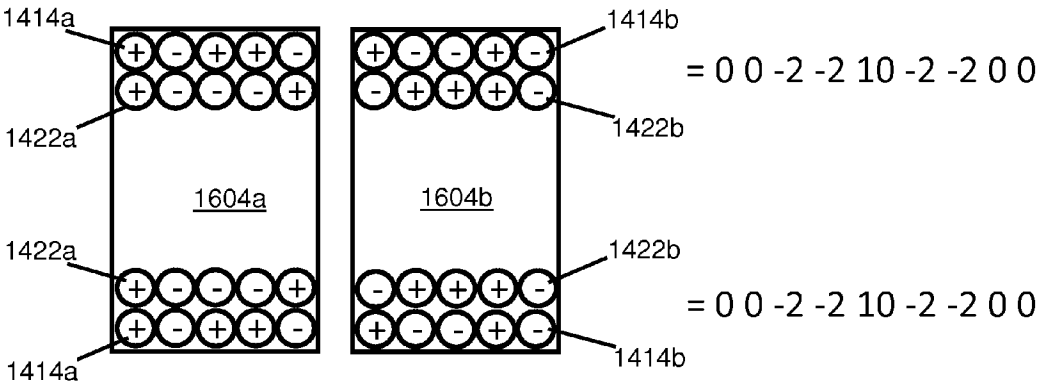
FIG. 16B depicts two objects each having two complementary coded magnetic structures with the same correlation functions that are arranged to achieve a second degree of balanced magnetic forces as one of the two objects moves past the other.

FIG. 16B depicts two objects 1604*a* 1604*b* each having two complementary coded magnetic structures with the same correlation functions that are arranged to achieve a second degree of balanced magnetic forces as one of the two objects moves past the other. The magnetic structure of FIG. 16A are identical on the top but their order is reversed on the bottom. As such, the correlation function for the bottom complementary structures will remain the same. Field lines of the bottom complementary structures of FIGS. 16A and 16B will be different with those of FIG. 16B being more symmetrical with those produced by the top complementary magnetic structures.

Figure 17A:
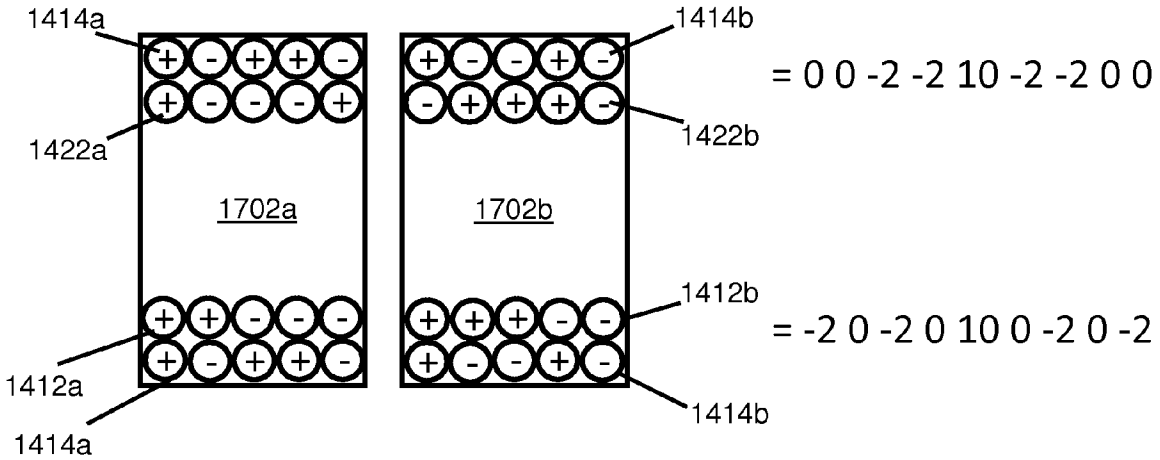
FIGS. 17A and 17B each depict two objects each having two complementary coded magnetic structures with different correlation functions arranged such that unbalanced magnetic forces will be produced as one of the two objects moves past the other.
Figure 17B:
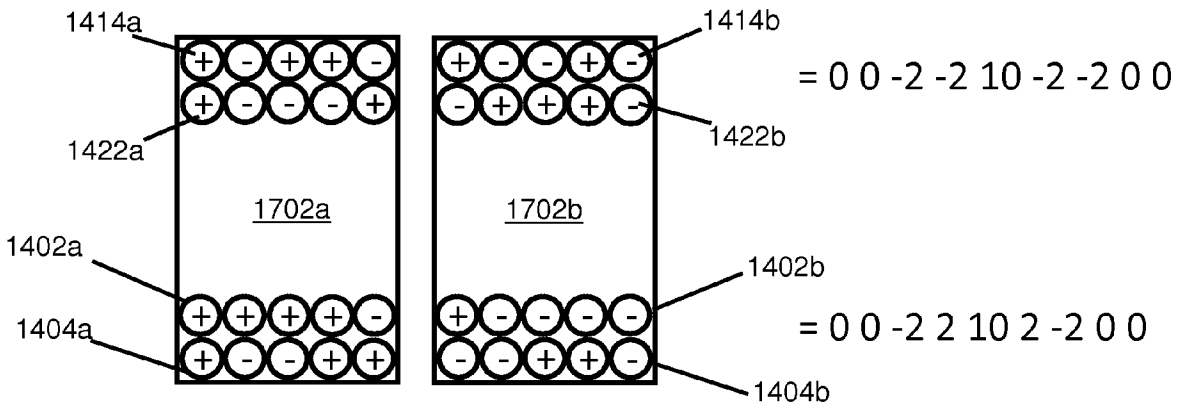

FIGS. 17A and 17B each depict two objects each having two complementary coded magnetic structures with different correlation functions arranged such that unbalanced magnetic forces will be produced as one of the two objects moves past the other. Referring to FIG. 17A, there are alignments where the top magnetic structures produce zero forces while the bottom magnetic structures produce repel forces and vice versa. Referring to FIG. 17B, there are alignments where the top magnetic structures produce repel forces while the bottom magnetic structures produce attract forces.

Figure 18:
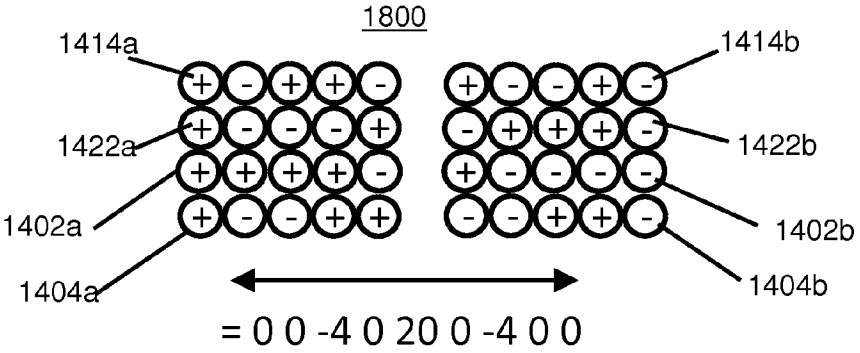
FIG. 18 depicts complementary coded structures where the peak force to maximum off peak force ratio is 5 in the direction of movement indicated by the double arrow

FIG. 18 depicts an exemplary magnetic system 1800 of two magnetic structures each comprising four one-dimensional complementary coded structures in parallel, where the peak force to maximum off peak force ratio of the combined structures is 5 in the direction of movement indicated by the double arrow. Specifically, the four correlation functions of the respective portions add to produce a combined correlation function of 0 0 −4 0 20 0 −4 0 0, where the peak force is 20 and maximum off peak force is −4. The peak force to maximum off peak force ratio equals ABS(20/−4) or 5.0.

Figure 19A:
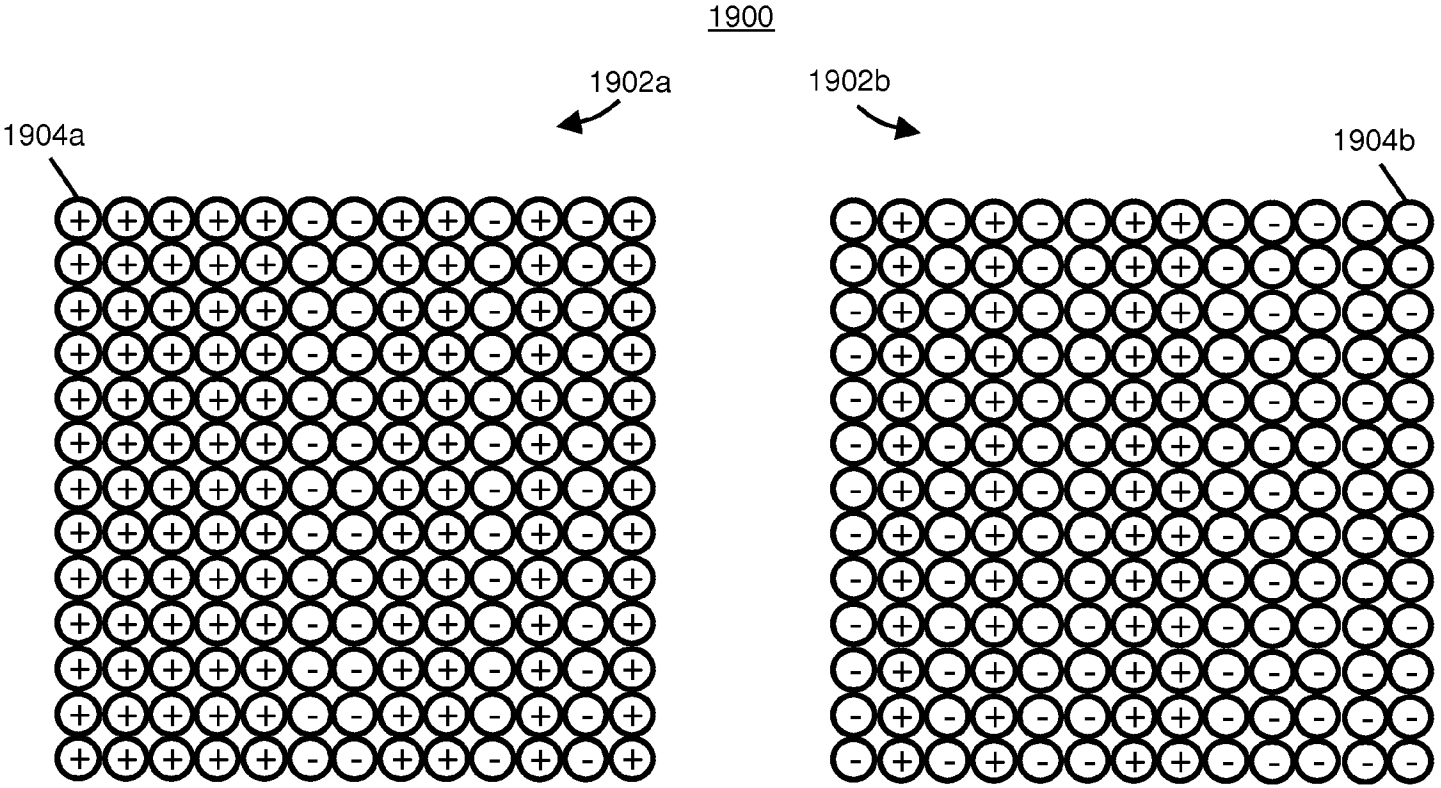
FIG. 19A depicts an exemplary magnetic system of two magnetic structures each comprising Barker 13 coded stripes.

FIG. 19A depicts an exemplary magnetic system 1900 of two magnetic structures 1902*a* 1902*b* each comprising Barker 13 coded stripes. The two magnetic structures 1902*a* 1902*b* each comprise 13 rows and 13 columns of magnetic sources where the rows are each coded in accordance with a Barker 13 code. Specifically, the first magnetic structure 1902*a* has 13 rows coded left to right from maxel 1904*a* with a Barker 13 coded pattern. Similarly, the second magnetic structure has 13 rows coded left to right from maxel 1904*b* with a complementary Barker 13 coded pattern.

Figure 19B:
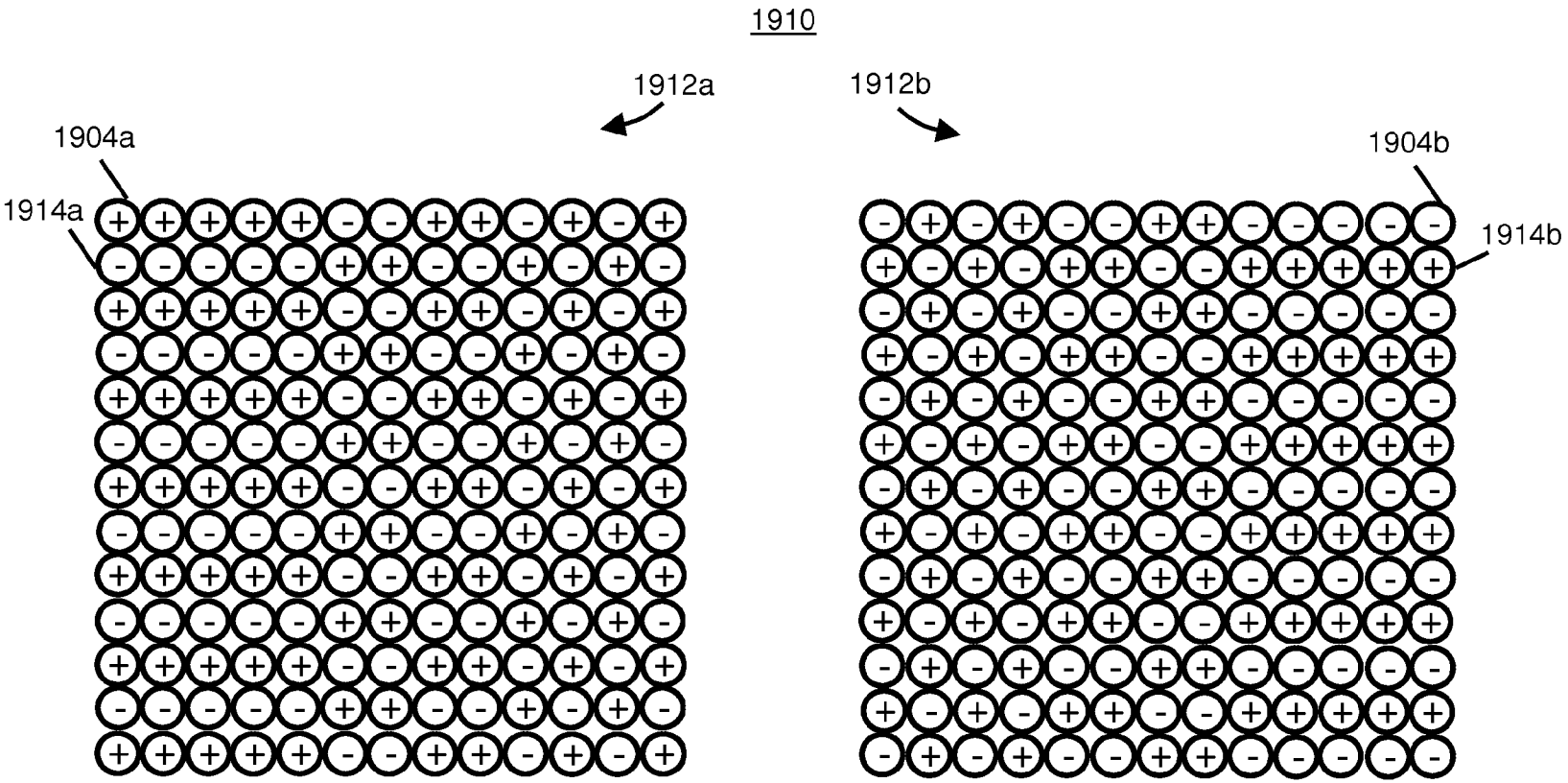
FIG. 19B depicts an exemplary magnetic system of two magnetic structures each comprising Barker 13 coded stripes where every other row is interleaved with a complementary Barker 13 coded pattern.

FIG. 19B depicts an exemplary magnetic system 1910 of two magnetic structures 1912*a* 1912*b* each comprising Barker 13 coded stripes where every other row is interleaved with a complementary Barker 13 coded pattern. As seen in FIG. 19B, the odd rows of the first magnetic structure 1912*a* are coded left to right (e.g., from maxel 1904*a* in the first row) with a Barker 13 coded pattern and the even rows of the magnetic structure are coded left to right (e.g., from maxel 1914*a* in the second row) with a complementary Barker 13 coded pattern. Similarly, the odd rows of the second magnetic structure 1912*b* are coded right to left (e.g., from maxel 1904*b* in the first row) with a complementary Barker 13 coded pattern and the even rows of the magnetic structure 1912*b* are coded right to left (e.g., from maxel 1914*b* in the second row) with a Barker 13 coded pattern. By interleaving the rows shunting effects are increased resulting in a concentration of magnetic flux near the surface and also shear forces are increased.

Figure 19C:
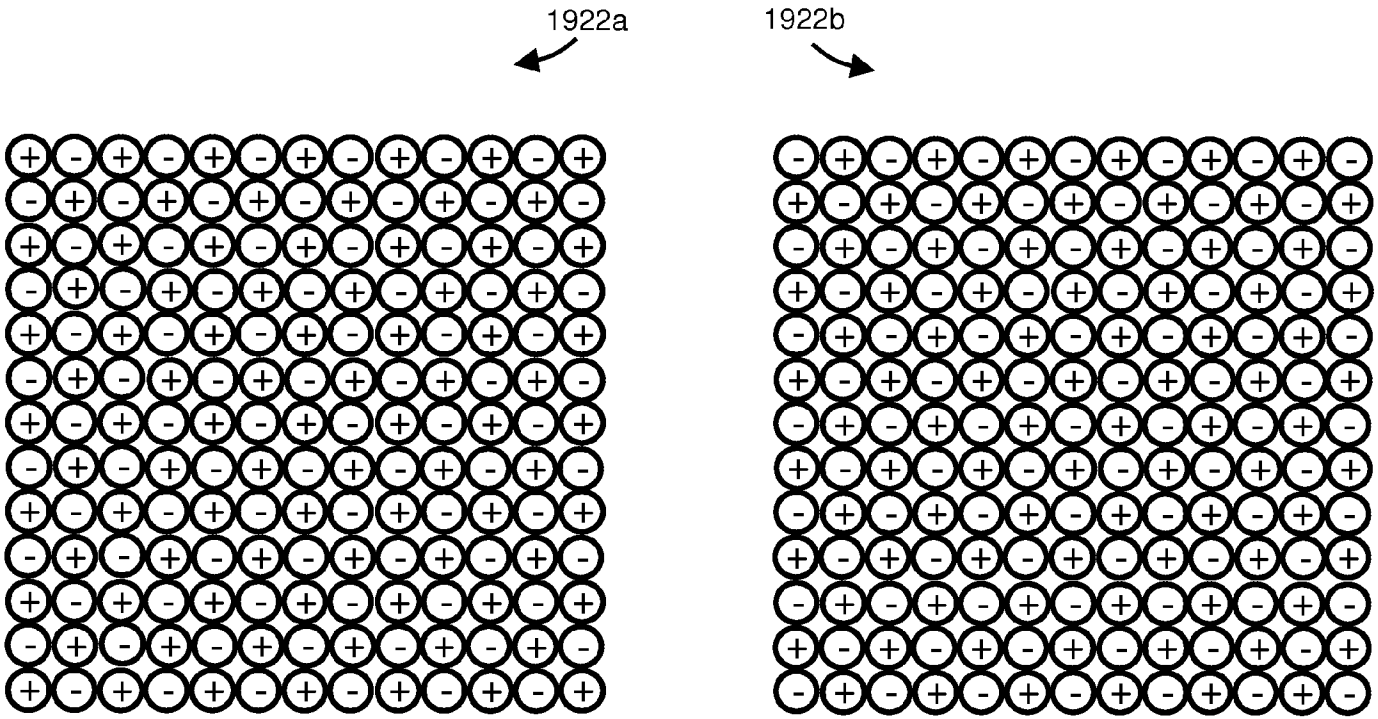
FIG. 19C depicts an exemplary magnetic system of two magnetic structures each comprising a checkerboard pattern where magnetic sources alternate in both dimensions.

FIG. 19C depicts an exemplary magnetic system 1920 of two magnetic structures 1922*a* 1922*b* each comprising a checkerboard pattern where magnetic sources alternate in both dimensions.

Figure 19D:
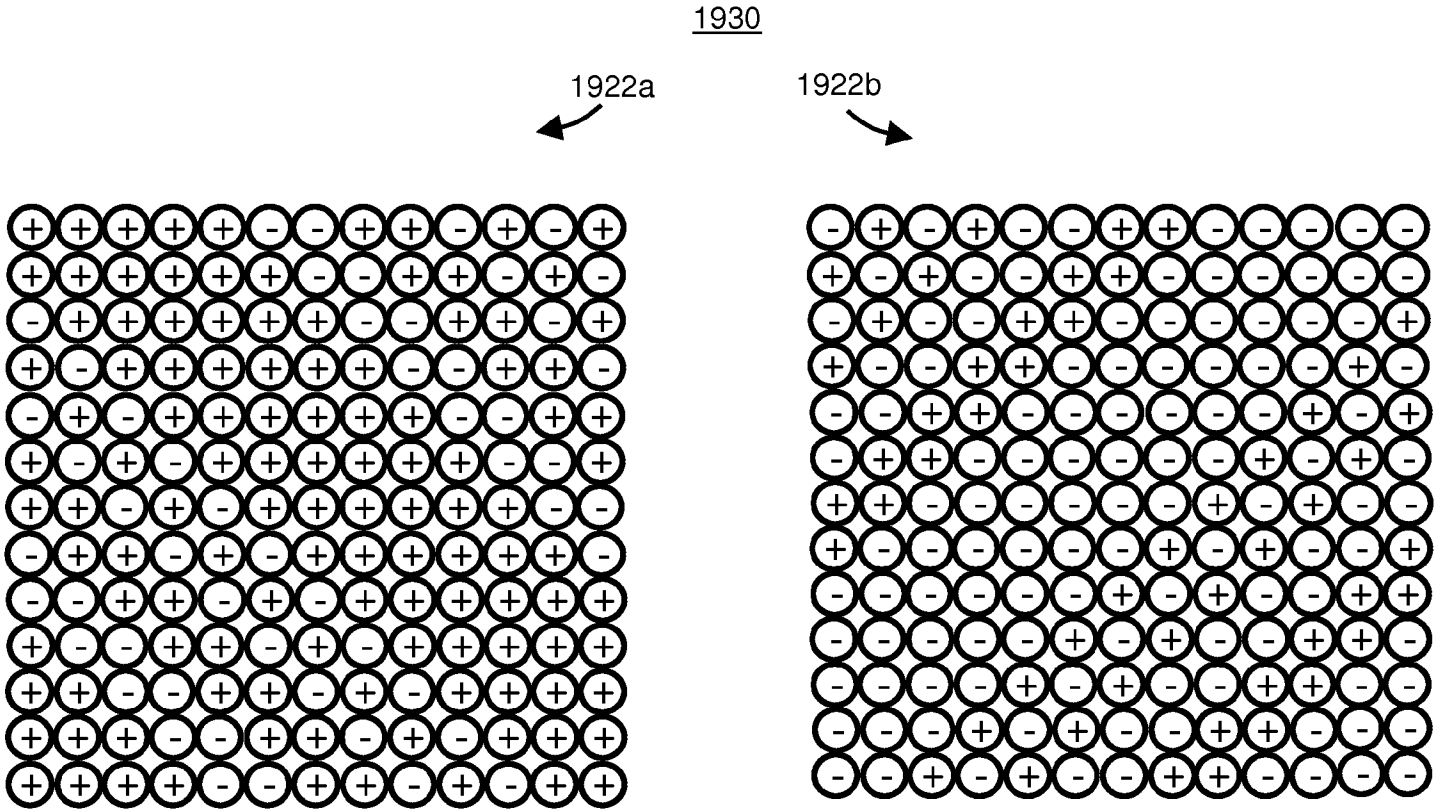
FIG. 19D depicts an exemplary magnetic system of two magnetic structures each comprising a two dimensional Barker 13 coded structure where rows are the same as the row above but shifted to the right one maxel and the remaining maxel brought around to the left side.

FIG. 19D depicts an exemplary magnetic system 1930 of two magnetic structures 1922*a* 1922*b* each comprising a two dimensional Barker 13 coded structure where rows are the same as the row above but shifted to the right one maxel and the remaining maxel brought around to the left side.

Figure 19E:
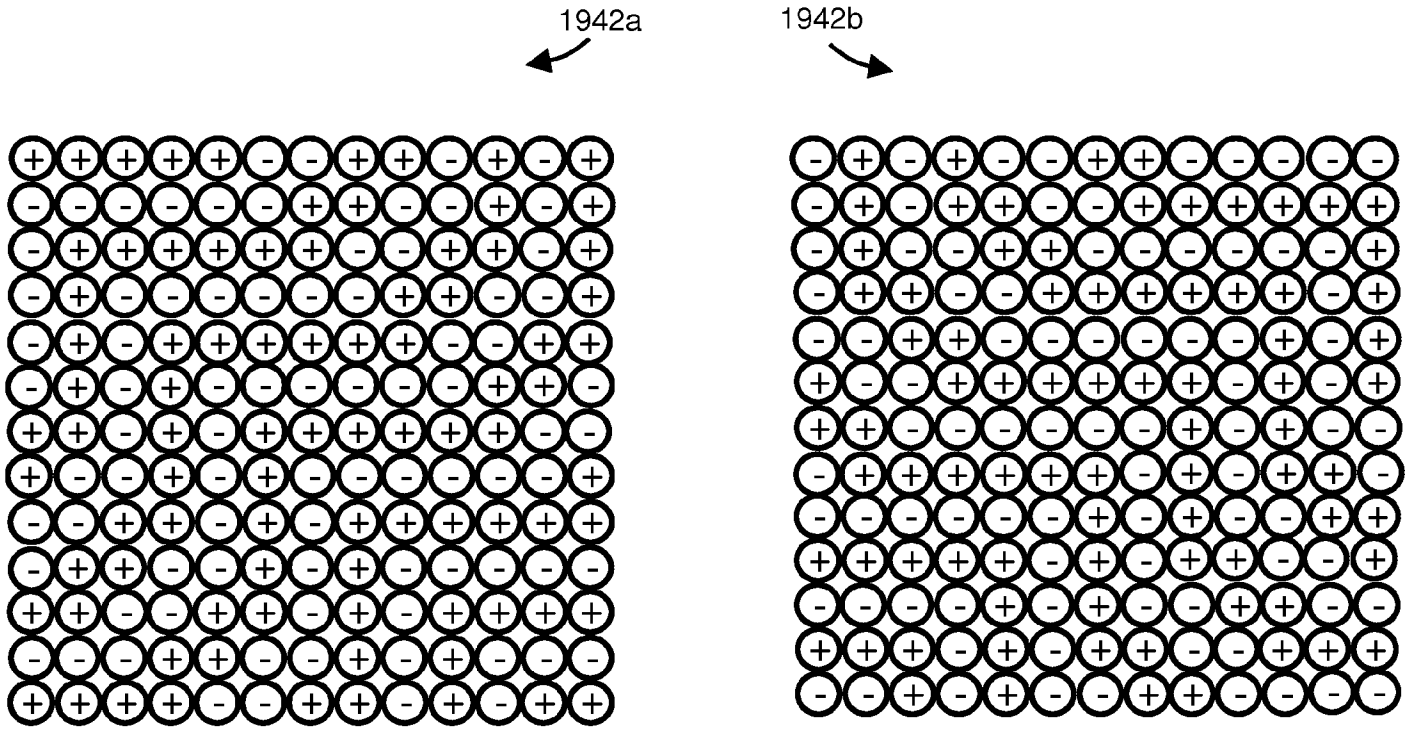
FIG. 19E depicts an exemplary magnetic system of two magnetic structures like those of FIG. 19D except every other row is interleaved with a complementary pattern.

FIG. 19E depicts an exemplary magnetic system 1940 of two magnetic structures 1942*a* 1942*b* like those of FIG. 19D except every other row is interleaved with a complementary pattern such as was described in relation to FIG. 19B.

Summary of Coded Magnet Patterns

Magnet patterns have been shown for basic linear and two dimensional arrays. Linear codes may be applied to generate linear magnet arrays arranged in straight lines, curves, circles, or zigzags. The magnetic axes may be axial or radial to the curved lines or surfaces. Two dimensional codes may be applied to generate two dimensional magnet arrays conforming to flat or curved surfaces, such as planes, spheres, cylinders, cones, and other shapes. In addition, compound shapes may be formed, such as stepped flats and more.

Magnet applications typically involve mechanical constraints such as rails, bearings, sleeves, pins, etc that force the assembly to operate along the dimensions of the code. Several known types of codes can be applied to linear, rotational, and two-dimensional configurations. Some configurations with lateral and rotational and vertical and tilt degrees of freedom may be satisfied with known codes tested and selected for the additional degrees of freedom. Computer search can also be used to find special codes.

Thus, the application of codes to generate arrangements of magnets with new interaction force profiles and new magnetic properties enables new devices with new capabilities.

CONCLUSION

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A magnetic field force generator for producing a magnetic force profile comprising:

a first composite magnet structure comprising a first magnet array and a second magnet array; said first magnet array based on a first magnet pattern, said second magnet array based on a second magnet pattern, said second magnet pattern differing from said first magnet pattern;

said first composite magnet structure configured for use with a complementary composite magnet structure comprising a first complementary magnet array and a second complementary magnet array, said complementary composite magnet structure being complementary to said first composite magnet structure;

said first magnet pattern comprising a sequence of two magnets having the same polarity along a direction of relative motion between said first composite magnet structure and said complementary composite magnet structure; said first magnet pattern also comprising a sequence of three magnets having alternating polarity along said direction of relative motion.

2. The magnetic field force generator as recited in claim 1, further including said complementary composite magnet structure.

3. The magnetic field force generator as recited in claim 1, wherein said first magnet pattern is a Barker code, a maximal length PN code, a Golomb ruler code, a Gold code, a Kasami code, or a Costas array.

4. The magnetic field force generator as recited in claim 1, wherein said first magnet pattern is a discrete pattern with a fixed element width and said magnetic force profile has a single maximum peak magnitude; wherein said magnetic force profile has a maximum magnitude, spaced from said maximum peak magnitude by at least one said element width, of less than half of said maximum peak magnitude.

5. The magnetic field force generator as recited in claim 1, wherein said first composite magnet structure has a force profile having a higher peak to sidelobe ratio than either said first magnet array or said second magnet array.

6. The magnetic field force generator as recited in claim 1, said first magnet pattern based on a code having an autocorrelation function with a single maximum peak per code modulo and a plurality of off maximum peak magnitude values; wherein a greatest peak magnitude value of said plurality of off maximum peak magnitude values is less than one half of the single maximum peak magnitude value; said first composite magnet structure and said complementary composite magnet structure having an operational range of relative position; wherein magnetic force between said first composite magnet structure and said complementary composite magnet structure as a function of position within said operational range corresponds to said autocorrelation function.

7. The magnetic field force generator as recited in claim 1, wherein the first magnet array is arranged along a first circle.

8. The magnetic field force generator as recited in claim 7, wherein the second magnet array is arranged along a second circle concentric to said first circle.

9. The magnetic field force generator as recited in claim 1, wherein the first magnet array is a linear array.

10. The magnetic field force generator as recited in claim 1, wherein the second magnet array differs in polarity from the first magnet array.

11. The magnetic field force generator as recited in claim 1, wherein the second magnet array differs in direction from the first magnet array.

12. The magnetic field force generator as recited in claim 1, wherein the second magnet array is parallel to the first magnet array.

13. The magnetic field force generator as recited in claim 1, wherein the second magnet array shares at least one magnet with the first magnet array.

14. The magnetic field force generator as recited in claim 1, wherein the first magnet pattern has a length of at least four.

15. The magnetic field force generator as recited in claim 1, wherein the first magnet pattern has a length of at least five.

16. The magnetic field force generator as recited in claim 1, wherein the second magnet array is configured to equalize the magnitudes of opposite polarities of the magnets of the first composite magnet structure, thereby reducing a far field magnetic field from the first composite magnet structure.

17. The magnetic field force generator as recited in claim 1, further including a second composite magnet structure spaced from said first composite magnet structure in fixed relationship to said first composite magnet structure; said second composite magnet structure for cooperating with a second complementary composite magnet structure to produce said force profile.

18. A magnetic field force generator for producing a magnetic force profile comprising:

a first compound magnet structure comprising a plurality of magnet arrays; at least one array of said plurality of magnet arrays comprising magnets configured according to a first pattern; said plurality of magnet arrays configured according to a second pattern;

said first compound magnet structure configured for operation with a complementary compound magnet structure complementary to said first compound magnet structure.

said first pattern defining a sequence of at least two magnets having the same polarity along a direction of relative motion between said first compound magnet structure and said complementary compound magnet structure; said first pattern also defining a sequence of at least three magnets having alternating polarity along said direction of relative motion.

19. The magnetic field force generator as recited in claim 18, wherein said second pattern defines, at least in part, a polarity of each array of said plurality of magnet arrays.

20. A magnetic field force generator for producing a magnetic force profile comprising:

a first composite magnet structure comprising a first magnet array and a second magnet array; said first magnet array based on a first pattern, said second magnet array based on a second pattern, said second pattern differing from said first pattern;

said first composite magnet structure configured for use with a complementary composite magnet structure comprising a first complementary magnet array and a second complementary magnet array, said complementary composite magnet structure complementary to said first composite magnet structure;

wherein said first composite magnet structure has a force profile having a higher peak to sidelobe ratio than either said first magnet array or said second magnet array.

21. A magnetic field force generator for producing a magnetic force profile comprising:

a first magnet structure comprising a first plurality of magnets; said first plurality of magnets arranged according to a first magnet pattern;

a second magnet structure comprising a second plurality of magnets; said second magnet structure arranged based on a second magnet pattern; said second magnet pattern differing from said first magnet pattern, said second magnet pattern differing from a complementary pattern to said first magnet pattern;

said first magnet pattern comprising a sequence of at least two magnets having the same polarity along a direction of relative motion between said first magnet structure and said second magnet structure; said first magnet pattern also comprising a sequence of at least three magnets having alternating polarity along said direction of relative motion.

* * * * *